US009235144B2

(12) United States Patent
Yamamoto et al.

(10) Patent No.: US 9,235,144 B2
(45) Date of Patent: Jan. 12, 2016

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Yuki Yamamoto, Tokyo (JP); Harunobu Ogaki, Suntou-gun (JP); Akihiro Maruyama, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 63 days.

(21) Appl. No.: 14/030,995

(22) Filed: Sep. 18, 2013

(65) Prior Publication Data

US 2014/0093815 A1 Apr. 3, 2014

(30) Foreign Application Priority Data

Sep. 28, 2012 (JP) ..... 2012-215700
Feb. 27, 2013 (JP) ..... 2013-037485
Sep. 9, 2013 (JP) ..... 2013-186345

(51) Int. Cl.

*G03G 5/05* (2006.01)
*G03G 5/047* (2006.01)
*G03G 5/06* (2006.01)
*G03G 5/147* (2006.01)

(52) U.S. Cl.

CPC ..... *G03G 5/047* (2013.01); *G03G 5/056* (2013.01); *G03G 5/0525* (2013.01); *G03G 5/0564* (2013.01); *G03G 5/0578* (2013.01); *G03G 5/0592* (2013.01); *G03G 5/0607* (2013.01); *G03G 5/0614* (2013.01); *G03G 5/14752* (2013.01); *G03G 5/14756* (2013.01); *G03G 5/14773* (2013.01)

(58) Field of Classification Search

CPC ..... G03G 5/047; G03G 5/056; G03G 5/0607; G03G 5/0614; G03G 5/14752; G03G 5/0564; G03G 5/0578

USPC ..... 430/59.6, 133, 134, 58.85, 58.2

See application file for complete search history.

(56) References Cited

U.S. PATENT DOCUMENTS

| | | | | |
|---|---|---|---|---|
| 7,585,604 | B2 | 9/2009 | Ogaki et al. | |
| 7,875,410 | B2 * | 1/2011 | Ogaki et al. | 430/59.6 |
| 7,901,855 | B2 | 3/2011 | Ogaki et al. | |
| 7,927,774 | B2 | 4/2011 | Ogaki et al. | |
| 2011/0177438 | A1 | 7/2011 | Noguchi et al. | |
| 2012/0243904 | A1 * | 9/2012 | Okuda et al. | 399/111 |
| 2012/0301181 | A1 | 11/2012 | Anezaki et al. | |
| 2013/0202326 | A1 | 8/2013 | Shida et al. | |
| 2013/0236823 | A1 | 9/2013 | Noguchi et al. | |
| 2014/0023961 | A1 | 1/2014 | Okuda et al. | |
| 2014/0023962 | A1 | 1/2014 | Okuda et al. | |

FOREIGN PATENT DOCUMENTS

| | | | | |
|---|---|---|---|---|
| EP | 2 306 248 | A1 | | 4/2011 |
| JP | 2002214807 | A | * | 7/2002 |
| JP | 2007-79555 | A | | 3/2007 |
| WO | 2010/008095 | A1 | | 1/2010 |
| WO | 2012/035944 | A1 | | 3/2012 |
| WO | 2012/074082 | A1 | | 6/2012 |

OTHER PUBLICATIONS

English language machine translation of JP 2002-214807 (Jul. 2002).*

Muruyama, et al., U.S. Appl. No. 14/079,390, filed Nov. 13, 2013.

Muruyama, et al., U.S. Appl. No. 14/078,502, filed Nov. 12, 2013.

European Search Report dated Jan. 23, 2014 in European Application No. 13186073.6.

* cited by examiner

*Primary Examiner* — Christopher Rodee

(74) *Attorney, Agent, or Firm* — Fitzpatrick, Cella, Harper and Scinto

(57) ABSTRACT

A charge-transporting layer includes a matrix-domain structure. The domain contains a polyester resin A. The matrix contains a charge-transporting substance and at least one of a polyester resin C and a polycarbonate resin D.

9 Claims, 1 Drawing Sheet

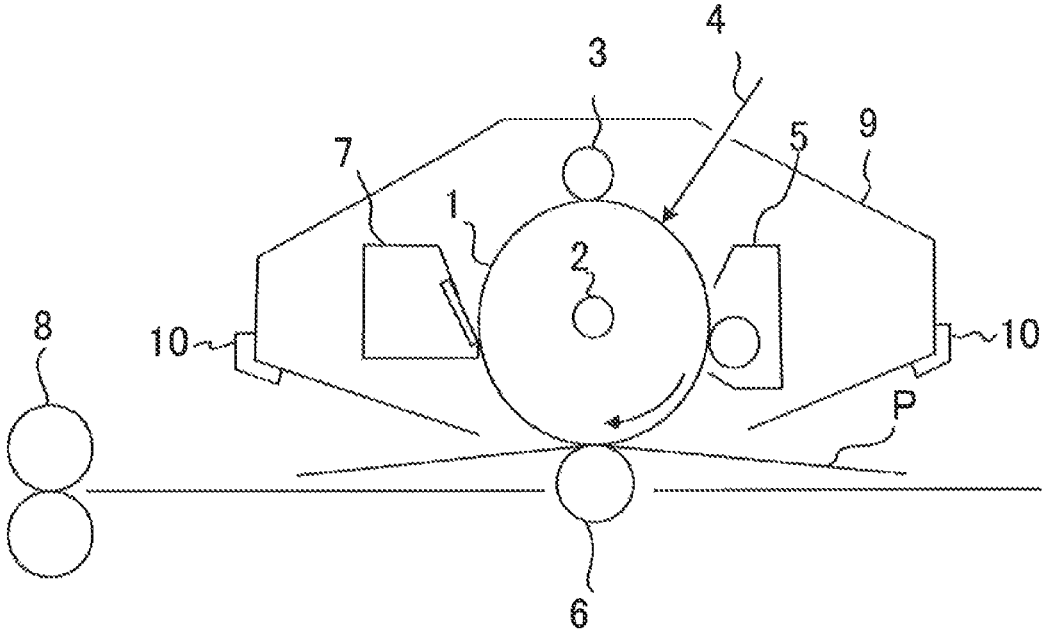
4
3
9
7
5
1
2
8
10
10
P
6

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus each having an electrophotographic photosensitive member.

2. Description of the Related Art

An electrophotographic photosensitive member which contains an organic photoconducting material is predominantly used as the electrophotographic photosensitive member to be installed on a process cartridge or an electrophotographic apparatus. In general, an electrophotographic photosensitive member includes a support and a photosensitive layer which contains an organic photoconducting material on the support. The photosensitive layer is typically of a lamination type (sequential layer type), formed of a charge-generating layer and a charge-transporting layer laminated in this order from the support side.

In an electrophotographic process, the surface of an electrophotographic photosensitive member comes in contact with various materials (hereinafter referred to as "a contact member") such as developer, a charging member, a cleaning blade, paper, and a transfer member. Examples of required characteristics for an electrophotographic photosensitive member therefore include reducibility of image deterioration due to contact stress with a contact member. In association with recent improvement in durability of an electrophotographic photosensitive member, further improvement is required in sustained effect of reduction in image deterioration due to the contact stress and in potential stability (reduction in potential variation) for repeating use.

Regarding sustained contact stress relaxation effect and potential stability for repeating use of an electrophotographic photosensitive member, a method for forming a matrix-domain structure in a surface layer using a siloxane resin having a siloxane structure integrated into a molecular chain is disclosed in International Publication No. WO2010/008095. According to the method, the use of a polyester resin having a specific siloxane structure allows for both of the sustained contact stress relaxation effect and the potential stability for repeating use of an electrophotographic photosensitive member.

The electrophotographic photosensitive member disclosed in International Publication No. WO2010/008095 achieves both of the sustained contact stress relaxation effect and the potential stability for repeating use.

However, the present inventors have found requirements for further improvement in the image deterioration caused by a photo memory due to a potential difference between a portion irradiated with light and a portion not irradiated with light.

SUMMARY OF THE INVENTION

The present invention is directed to providing an electrophotographic photosensitive member which simultaneously achieves the sustained contact stress relaxation, the potential stability for repeating use of the electrophotographic photosensitive member, and reduction in photo memory, at high levels; and a process cartridge and an electrophotographic apparatus each having the electrophotographic photosensitive member.

According to one aspect of the present invention, there is provided an electrophotographic photosensitive member comprising: a support; a charge-generating layer formed on the support; and a charge-transporting layer formed on the charge-generating layer; wherein, the charge-transporting layer is a surface layer of the electrophotographic photosensitive member, the charge-transporting layer has a matrix-domain structure having: a domain which includes a polyester resin A having: a structural unit represented by the following Formula (A) and a structural unit represented by the following Formula (B), and a matrix which includes: a charge-transporting substance, and at least one resin selected from the group consisting of a polyester resin C having a structural unit represented by the following Formula (C) and a polycarbonate resin D having a structural unit represented by the following Formula (D), the content of the structural unit represented by Formula (A) is 6% by mass or more and 40% by mass or less based on the total mass of the polyester resin A, and the content of the structural unit represented by Formula (B) is 60% by mass or more and 94% by mass or less based on the total mass of the polyester resin A.

(A)

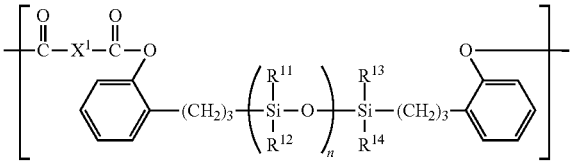

In Formula (A), $X^1$ represents a m-phenylene group, a p-phenylene group, or a bivalent group having two p-phenylene groups bonded to an oxygen atom, $R^{11}$ to $R^{14}$ each independently represent a methyl group, an ethyl group, or a phenyl group, n represents the number of repetitions of a structure in brackets, and the average value of n in the polyester resin A is 20 or more and 120 or less.

(B)

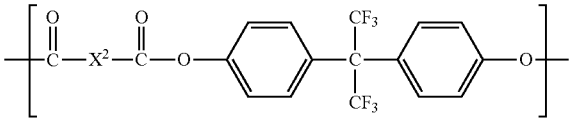

In Formula (B), $X^2$ represents a m-phenylene group, a p-phenylene group, or a bivalent group having two p-phenylene groups bonded to an oxygen atom.

(C)

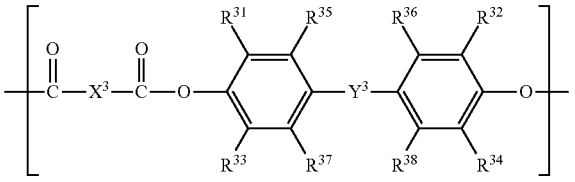

In Formula (C), $R^{31}$ to $R^{38}$ each independently represent a hydrogen atom, or a methyl group, $X^3$ represents a m-phenylene group, a p-phenylene group, or a bivalent group having two p-phenylene groups bonded to an oxygen atom, and $Y^3$ represents a single bond, a methylene group, an ethylidene group, or a propylidene group.

(D)

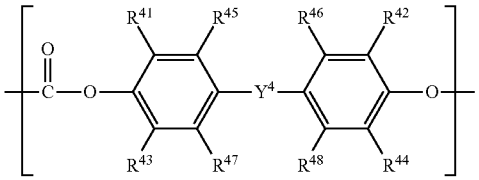

In Formula (D), $R^{41}$ to $R^{48}$ each independently represent a hydrogen atom, or a methyl group, and $Y^4$ represents a methylene group, an ethylidene group, a propylidene group, a phenylethylidene group, a cyclohexylidene group, or an oxygen atom.

According to another aspect of the present invention, there is provided a process cartridge which integrally supports the electrophotographic photosensitive member and at least one unit selected from a group consisting of a charging unit, a developing unit, a transferring unit and a cleaning unit, and is detachably attached to an electrophotographic apparatus body.

According to further aspect of the present invention, there is provided an electrophotographic apparatus having the electrophotographic photosensitive member, a charging unit, a developing unit, and a transferring unit.

According to the present invention, there is provided an electrophotographic photosensitive member to simultaneously achieve the sustained contact stress relaxation, the potential stability for repeating use of the electrophotographic photosensitive member, and reduction in photo memory for repeating use, at high levels, and a process cartridge and an electrophotographic apparatus each having the electrophotographic photosensitive member.

Further features of the present invention will become apparent from the following description of exemplary embodiments with reference to the attached drawings.

BRIEF DESCRIPTION OF THE DRAWINGS

FIGURE is a schematic view of an electrophotographic apparatus provided with a process cartridge having an electrophotographic photosensitive member of the present invention.

DESCRIPTION OF THE EMBODIMENTS

Preferred embodiments of the present invention will now be described in detail in accordance with the accompanying drawings.

An electrophotographic photosensitive member of the present invention comprises a charge-transporting layer having a matrix-domain structure which includes the following matrix and the following domain. The domain includes a polyester resin A having a structural unit represented by the following Formula (A) and a structural unit represented by the following Formula (B). The matrix includes a charge-transporting substance, and at least one resin selected from the group consisting of a polyester resin C having a structural unit represented by the following Formula (C) and a polycarbonate resin D having a structural unit represented by the following Formula (D).

(A)

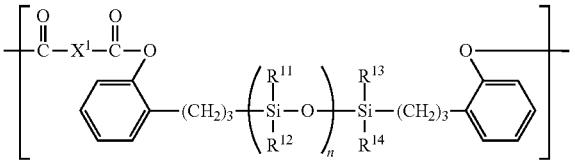

In Formula (A), X' represents a m-phenylene group, a p-phenylene group, or a bivalent group having two p-phenylene groups bonded to an oxygen atom, $R^{11}$ to $R^{14}$ each independently represent a methyl group, an ethyl group, or a phenyl group, n represents the number of repetitions of a structure in brackets, and the average value of n in the polyester resin A is 20 or more and 120 or less.

(B)

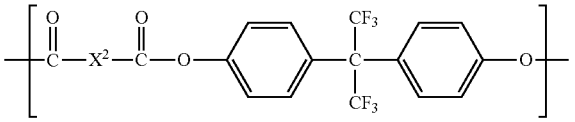

In Formula (B), $X^2$ represents a m-phenylene group, a p-phenylene group, or a bivalent group having two p-phenylene groups bonded to an oxygen atom.

(C)

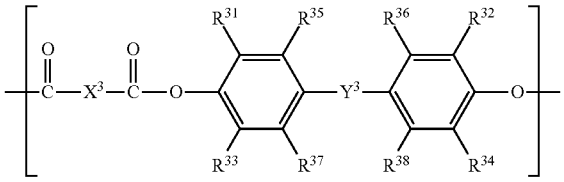

In Formula (C), $R^{31}$ to $R^{38}$ each independently represent a hydrogen atom, or a methyl group, $X^3$ represents a m-phenylene group, a p-phenylene group, or a bivalent group having two p-phenylene groups bonded to an oxygen atom, and $Y^3$ represents a single bond, a methylene group, an ethylidene group, or a propylidene group.

(D)

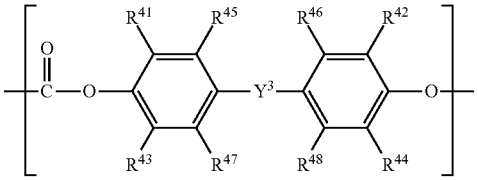

In Formula (D), $R^{41}$ to $R^{48}$ each independently represent a hydrogen atom, or a methyl group, and $Y^4$ represents a methylene group, an ethylidene group, a propylidene group, a phenylethylidene group, a cyclohexylidene group, or an oxygen atom.

[Polyester Resin A]

A polyester resin A is described below. The content of a structural unit represented by Formula (A) is 6% by mass or more and 40% by mass or less based on the total mass of the polyester resin A. The content of a structural unit represented by Formula (B) is 60% by mass or more and 94% by mass or less based on the total mass of the polyester resin A. More preferably the content of a structural unit represented by Formula (A) is 10% by mass or more and 40% by mass or less based on the total mass of the polyester resin A, and the content of a structural unit represented by Formula (B) is 60% by mass or more and 90% by mass or less based on the total mass of the polyester resin A.

A content of a structural unit represented by Formula (A) of 6% by mass or more and 40% by mass or less based on the total mass of the polyester resin A allows a domain to be efficiently formed in a matrix including a charge-transporting substance and at least one resin selected from the group consisting of a polyester resin C and a polycarbonate resin D. This exhibits sustained contact stress relaxation effect. In addition, localization of the polyester resin A at the interface between a charge-transporting layer and a charge generating layer is prevented, the potential variation is reduced for repeating use. A content of a structural unit represented by Formula (B) of 60% by mass or more based on the total mass of the polyester resin A suppresses photo memory.

With a content of the structural unit represented by Formula (A) of 6% by mass or more and less than 10% by mass based on the total mass of the polyester resin A and a content of the structural unit represented by Formula (B) of more than 90% by mass and 94% by mass or less based on the total mass of the polyester resin A, a matrix-domain structure may be also formed in the charge-transporting layer.

The polyester resin A includes a structural unit represented by the above Formula (A) and a structural unit represented by the above Formula (B).

In Formula (A), $X^1$ represents a m-phenylene group, a p-phenylene group, or a bivalent group having two p-phenylene groups bonded to an oxygen atom. These groups may be used singly or in combination of two or more groups. In the combination use of a m-phenylene group and a p-phenylene group, the ratio (molar ratio) of m-phenylene groups to p-phenylene groups may be from 1:9 to 9:1, more preferably from 3:7 to 7:3.

In Formula (A), $R^{11}$ to $R^{14}$ each can be a methyl group for the sustained contact stress relaxation.

In Formula (A), n in the polyester resin A has an average value of 20 or more and 120 or less. An n of 20 or more and 120 or less allows a domain to be efficiently formed in a matrix including a charge-transporting substance, a polyester resin C and/or a polycarbonate resin D. In particular, n can have an average value of 40 or more and 80 or less. The number n of repetitions of a structure in brackets can be in the range of ±10% of the average value of number n of repetitions, allowing for providing stable effect of the present invention.

Examples of the structural unit represented by Formula (A) are described in the followings.

(A-1)

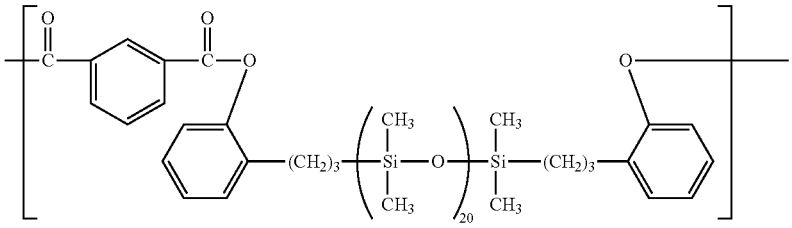

(A-2)

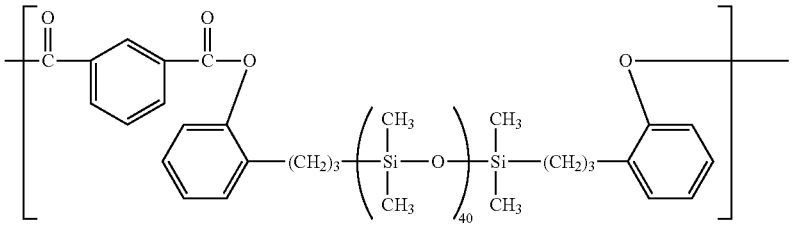

(A-3)

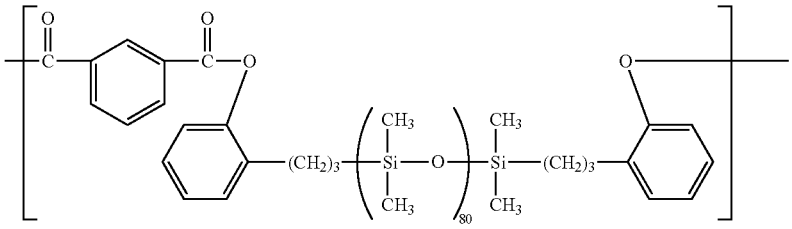

-continued
(A-4)
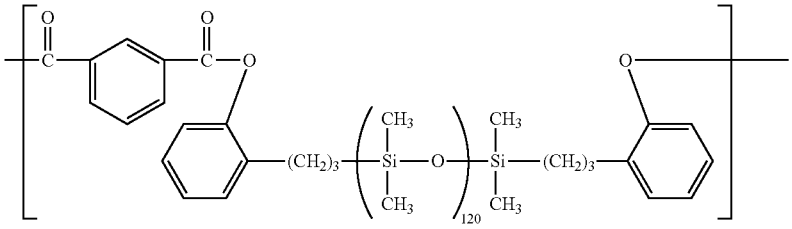
(A-5)
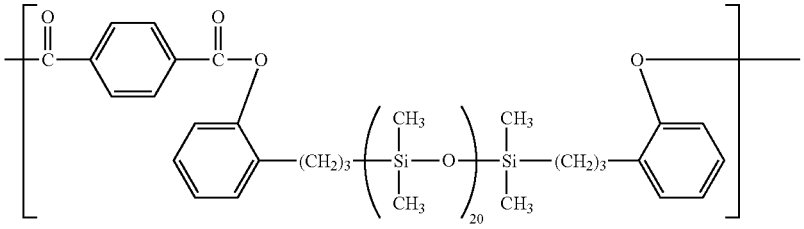
(A-6)
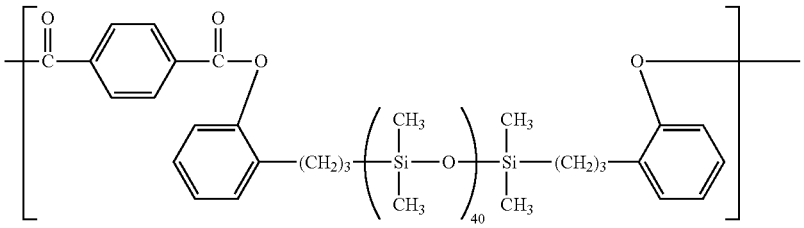
(A-7)
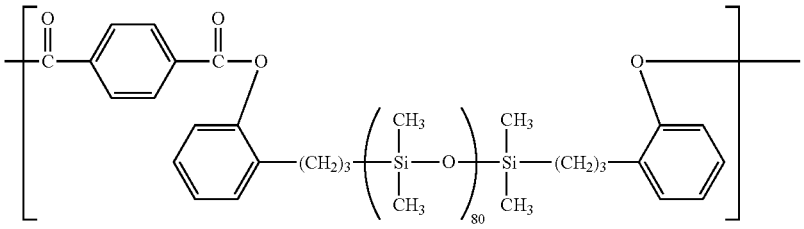
(A-8)
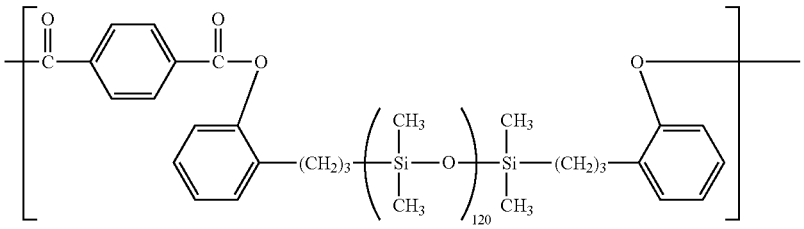
(A-9)
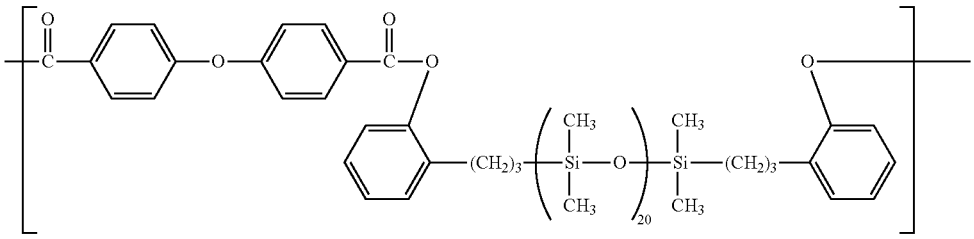

-continued
(A-10)
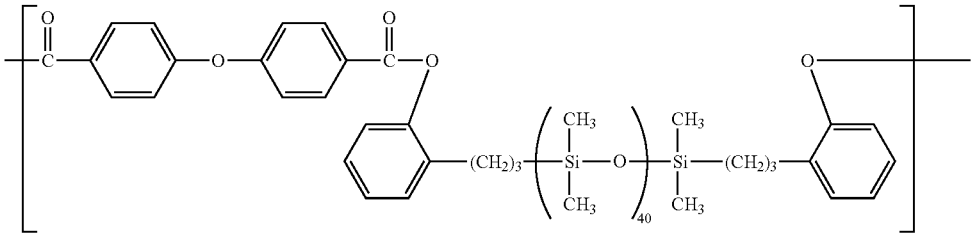
(A-11)
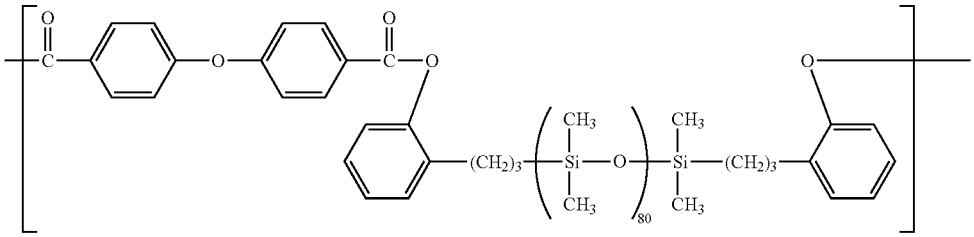
(A-12)
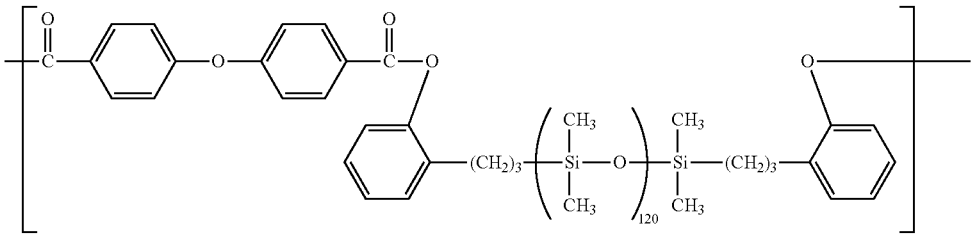
(A-13)
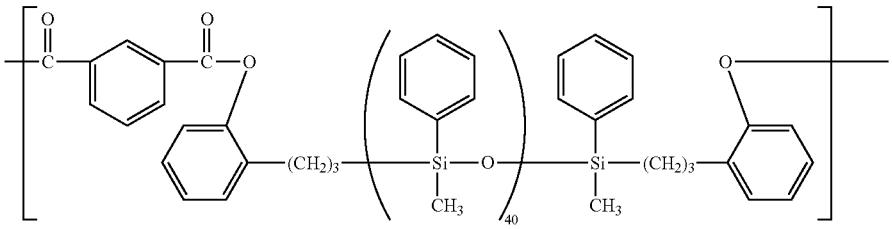
(A-14)
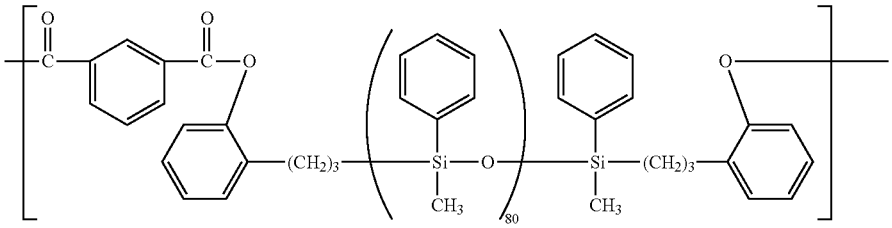
(A-15)
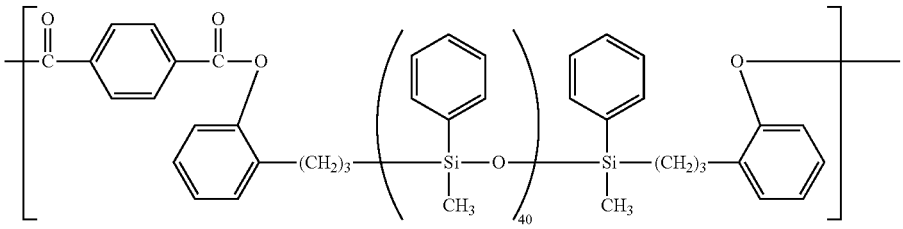

-continued
(A-16)
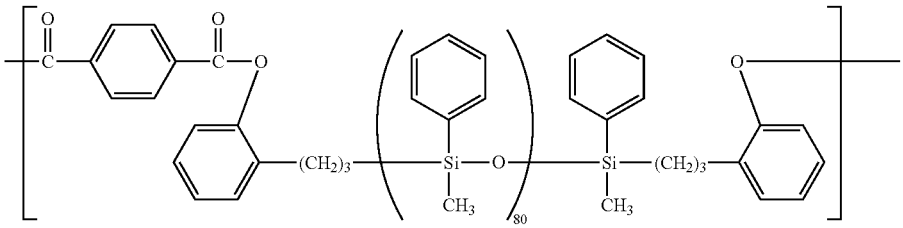
(A-17)
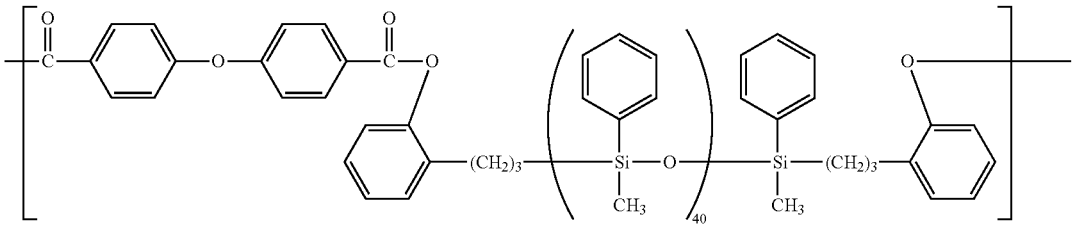
(A-18)
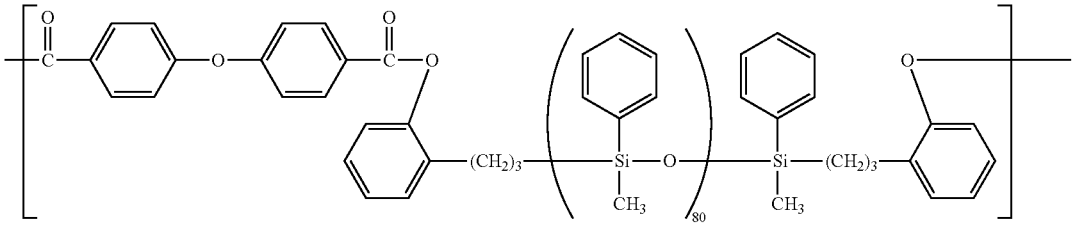
(A-19)
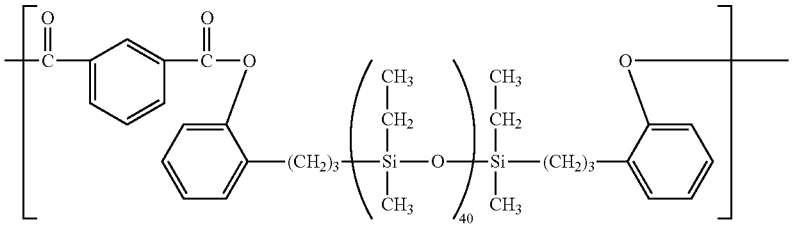
(A-20)
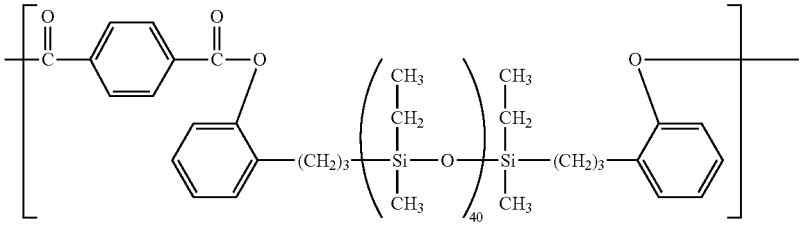
(A-21)
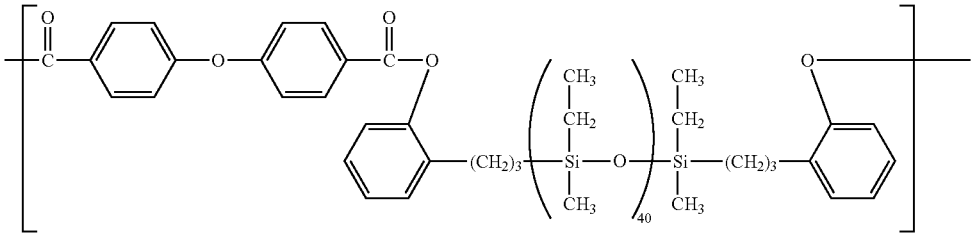

In particular, the structural unit represented by Formula (A-2), (A-3), (A-6), (A-7), (A-10) or (A-11) can be suitable for use. The structural units can be used singly or in combination. In the combination use of a m-phenylene group and a p-phenylene group as structural unit for $X^1$, the ratio (molar ratio) of m-phenylene groups to p-phenylene groups can be from 1:9 to 9:1, more preferably from 3:7 to 7:3.

Examples of the structural unit represented by Formula (B) are described in the followings.

(B-1)

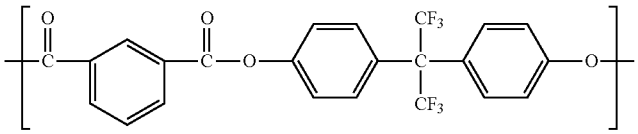

(B-2)

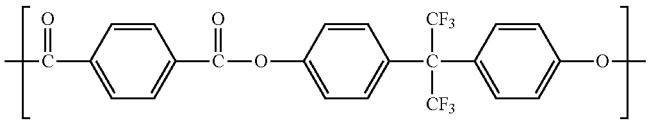

(B-3)

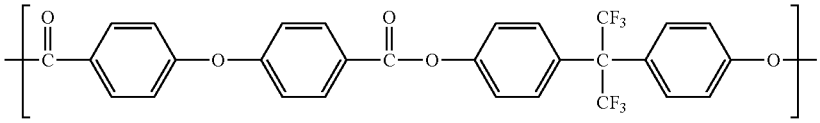

A structural unit other than the structural units represented by Formula (A) and Formula (B) may be used to constitute the polyester resin A. Examples include the structural units represented by the following Formulas (C-1) to (C-12). In the use of other structural unit, the content of the other structural unit can be 34% by mass or less based on the total mass of the polyester resin A in order to produce the effect of the present invention. More preferably the content is 30% by mass or less.

The polyester resin A is a copolymer of a structural unit represented by Formula (A) and a structural unit represented by Formula (B). The copolymerization form may be any of block copolymerization, random copolymerization, alternate copolymerization, and the like.

The polyester resin A can have a weight average molecular weight of 30,000 or more and 200,000 or less, in order to form a domain in a matrix including a charge-transporting substance and a polyester resin C and/or a polycarbonate resin D. A weight average molecular weight of 40,000 or more and 150,000 or less is more preferable.

In the present application, the weight average molecular weight of resin is represented according to the usual method, more specifically, by a polystyrene conversion weight average molecular weight measured by a method described in Japanese Patent Application Laid-Open No. 2007-79555.

The copolymerization ratio of the polyester resin A can be confirmed by a conversion method using a peak area ratio of hydrogen atoms (hydrogen atoms which constitute resin) through $^1$H-NMR measurement of the resin, which is an usual method.

The polyester resin A can be synthesized by a method described in International Publication No. WO2010/008095.

The content of the polyester resin A can be 10% by mass or more and 40% by mass or less based on the total mass of all the resins in the charge-transporting layer. A content of 10% by mass or more and 40% by mass or less allows a matrix-domain structure to be stably formed, simultaneously achieving the sustained contact stress relaxation, the potential stability for repeating use, and reduction in photo memory, at high levels. The polyester resin A can be used singly or in combination of two or more kinds.

At least a structural unit represented by Formula (B-3) can be included as the structural unit represented by Formula (B) for reduction in potential variation for repeating use. More preferably the content of a structural unit represented by Formula (B-3) is 30% by mass or more and 100% by mass or less based on the total mass of the structural unit represented by Formula (B) in the polyester resin A.

[Polyester Resin C]

A polyester resin C having a structural unit represented by Formula (C) is described in the followings.

$X^3$ in Formula (C) represents a m-phenylene group, a p-phenylene group, or a bivalent group having two p-phenylene groups bonded to an oxygen atom. The groups can be used singly or in combination of two or more kinds. In the combination use of a m-phenylene group and a p-phenylene group, the ratio (molar ratio) of m-phenylene groups to p-phenylene groups can be from 1:9 to 9:1, more preferably from 3:7 to 7:3.

$Y^3$ in Formula (C) can be a propylidene group.

Examples of the structural unit represented by Formula (C) are described in the followings.
(C-1)
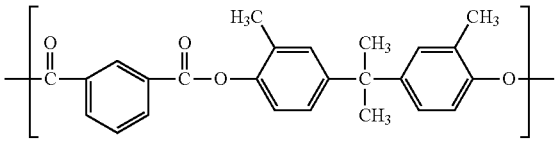
(C-2)
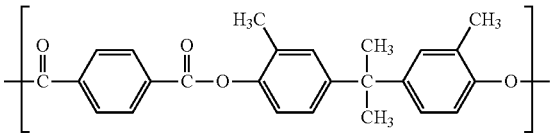
(C-3)
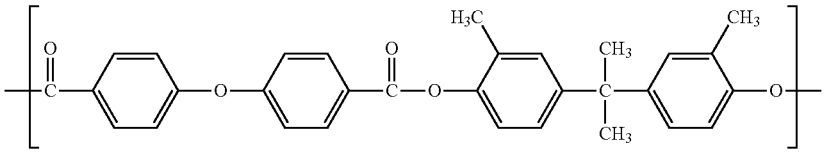
(C-4)
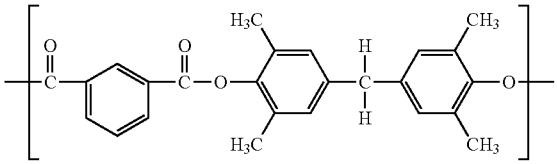
(C-5)
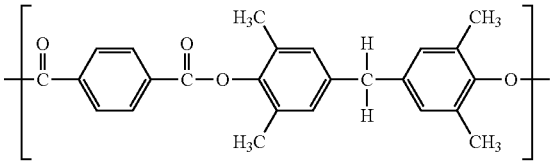
(C-6)
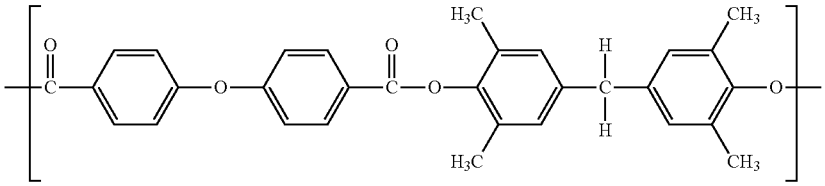
(C-7)
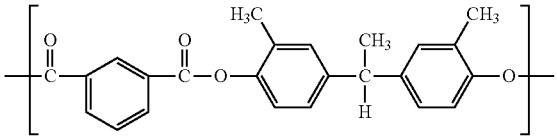
(C-8)
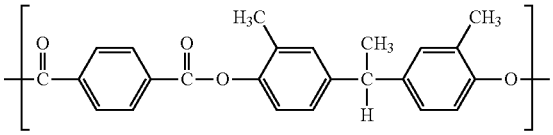
(C-9)
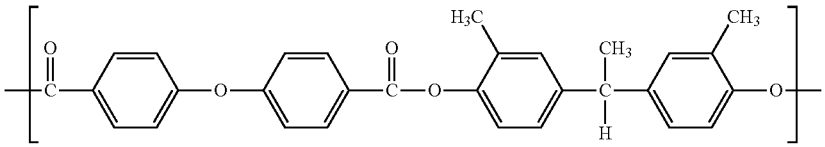
(C-10)
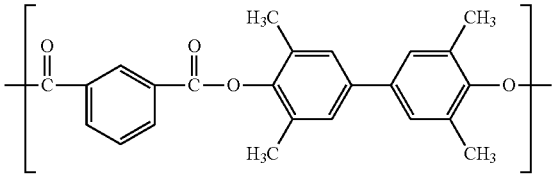
(C-11)
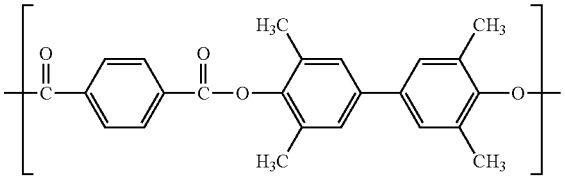
(C-12)
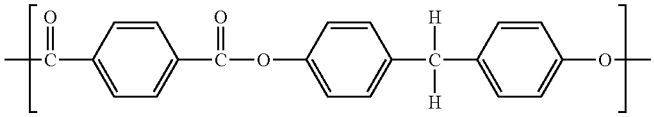

In particular, the structural unit represented by Formula (C-1), (C-2), (C-4), (C-5) or (C-9) can be suitable for use.

[Polycarbonate Resin D]

A polycarbonate resin D having a structural unit represented by Formula (D) is described in the followings.

$Y^4$ in Formula (D) can be a propylidene group or a cyclohexylidene group.

Examples of the structural unit represented by Formula (D) are described in the followings.

(D-1)

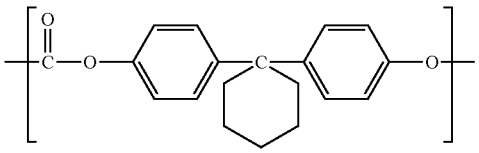

(D-2)

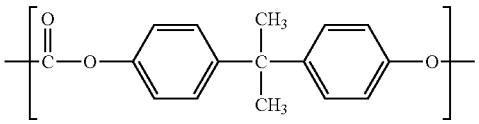

(D-3)

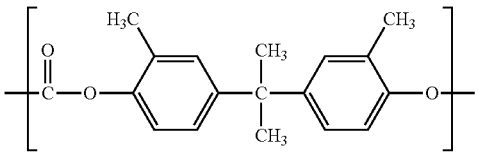

(D-4)

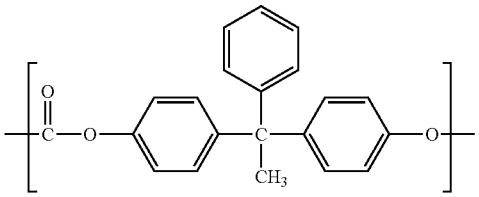

(D-5)

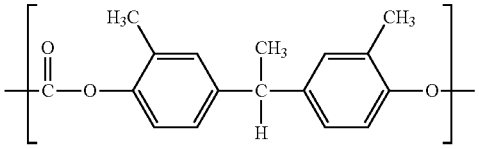

(D-6)

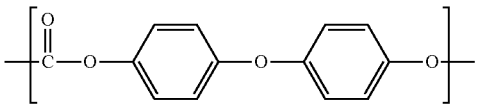

(D-7)

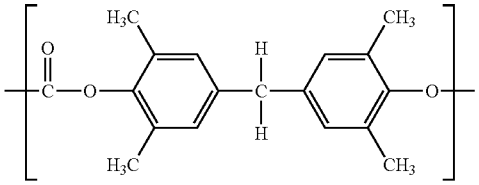

-continued (D-8)

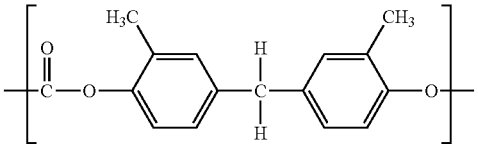

In particular, the structural unit represented by Formula (D-1), (D-2), (D-3) or (D-4) can be suitable for use.

A charge-transporting layer of the present application includes a matrix-domain structure having a matrix which contains at least one resin of a polyester resin C and a polycarbonate resin D and a domain which contains a polyester resin A in the matrix. A charge-transporting substance can be contained in the matrix.

The matrix-domain structure is "a sea island structure", wherein the matrix serves as a sea portion and the domain serves as an island. The domain which contains the polyester resin A has a particle-like (island-like) structure formed in a matrix which contains at least one resin of the polyester resin C and the polycarbonate resin D. The domains which contain the polyester resin A exist independently from each other in the matrix. The matrix-domain structure can be confirmed by the surface observation or section observation of the charge-transporting layer.

The state observation of the matrix-domain structure or the measurement of the domain can be performed, for example, with a laser microscope, an optical microscope, an electron microscope, and an atomic force microscope, which are commercially available. Using the microscope having a predetermined magnification power, the state observation of the matrix-domain structure or the measurement of the domain structure can be performed.

The domains which contain the polyester resin A can have a number average particle size of 100 nm or more and 1,000 nm or less. The particle size distribution in each of the domains can be narrow for uniformity of a coating film and stress relaxation effect. In order to obtain the number average particle size, 100 domains are arbitrarily selected from the domains in the vertically cut cross section of a charge-transporting layer with microscope observation. The maximum sizes of the respective selected domains are measured and averaged to obtain the number average particle size of the domains. Through the microscope observation of the cross section of a charge-transporting layer, image information in depth direction is obtained. The 3-dimensional image of a charge-transporting layer can be also obtained.

The matrix-domain structure of a charge-transporting layer can be formed with a coating film of a charge-transporting layer coating liquid, which contains a charge-transporting substance, a polyester resin A, and at least one resin of the polyester resin C and the polycarbonate resin D.

The matrix-domain structure is efficiently formed in the charge-transporting layer, so that the sustained contact stress relaxation effect can be exhibited. Since localization of the polyester resin A at the interface between a charge-transporting layer and a charge-generating layer is prevented, it is believed that the potential variation can be reduced for repeating use of the electrophotographic photosensitive member. The result is believed due to a reduced barrier to the charge mobility from a charge-generating layer to a charge-transporting layer.

A content of the structural unit represented by Formula (B) of 60% by mass or more and 94% by mass or less based on the total mass of the polyester resin A reduces photo memory. The result is believed due to the lower compatibility of the structural unit represented by Formula (B) in the polyester resin A and the charge-transporting substance compared with the compatibility of the structural unit of the resin which constitutes the matrix and the charge-transporting substance. This is believed specifically due to a perfluoroalkyl group (trifluoromethyl group) in the structural unit represented by Formula (B). It is believed that the amount of the charge-transporting substance incorporated into the domain is further reduced than the conventional amount due to the difference in the compatibility with the charge-transporting substance between the resin to constitute the matrix and the resin to constitute the domain, so that the charge-transporting substance is selectively disposed in the matrix. As a result, it is believed that the charge is prevented from staying in the domain at a portion exposed to light, so that the photo memory can be reduced. It is expected that the potential variation can be reduced for repeating use due to the reduced amount of the charge-transporting substance incorporated into the domain which contains the polyester resin A.

The image deterioration of the electrophotographic photosensitive member due to photo memory is believed to be reduced even in the case that the electrophotographic photosensitive member is exposed to light during attachment or detachment of a process cartridge to or from the main body of an electrophotographic apparatus.

The content of a structural unit represented by Formula (A) based on the total mass of the polyester resin A and the content of a structural unit represented by Formula (B) can be analyzed by a commonly-used analytical method. Examples of the analytical method are described in the followings.

The charge-transporting layer, which is the surface layer of an electrophotographic photosensitive member, is dissolved with a solvent. Subsequently, various materials contained in the charge-transporting layer as the surface layer are isolated with an isolation apparatus capable of separating and collecting respective composition components such as a size exclusion chromatography and a high performance liquid chromatography. The isolated polyester resin A is hydrolyzed in the presence of alkali or the like so as to decompose into a carboxylic acid portion and a bisphenol portion. Nuclear magnetic resonance spectroscopy or mass analysis is performed on the produced bisphenol portion so as to calculate the number of repetitions of the structural unit represented by Formula (A) and the structural unit represented by Formula (B), and the molar ratio between the units, which is converted to the content (mass ratio).

Examples of the synthesis of the polyester resin A are described in the followings.

The polyester resin A can be synthesized by a synthesis method described in International Publication No. WO2010/008095. In the present application, the polyester resins A described in synthesis examples in Table 1 were synthesized by the similar synthesis method using raw materials corresponding to the structural unit represented by Formula (A) and the structural unit represented by Formula (B). The structure and the weight average molecular weight of each of the synthesized polyester resins A are described in Table 1.

TABLE 1

| Synthesis example | Polyester resin A | Formula (A) Structural unit | Formula (A) Average value of n | Formula (B) | Formula (C) | Content of formula (A) | Content of formula (B) | Weight average molecular weight |
|---|---|---|---|---|---|---|---|---|
| 1 | Resin A(1) | (A-2)/(A-6) = 5/5 | 40(40/40) | (B-1)/(B-2) = 5/5 | — | 20 | 80 | 110,000 |
| 2 | Resin A(2) | (A-3)/(A-7) = 5/5 | 80(80/80) | (B-1)/(B-2) = 5/5 | — | 10 | 90 | 100,000 |
| 3 | Resin A(3) | (A-6)/(A-10) = 3/7 | 40(40/40) | (B-2)/(B-3) = 3/7 | — | 25 | 75 | 100,000 |
| 4 | Resin A(4) | (A-7)/(A-11) = 3/7 | 80(80/80) | (B-2)/(B-3) = 3/7 | — | 30 | 70 | 90,000 |
| 5 | Resin A(5) | (A-2)/(A-10) = 7/3 | 40(40/40) | (B-1)/(B-3) = 7/3 | — | 20 | 80 | 80,000 |
| 6 | Resin A(6) | (A-3)/(A-11) = 7/3 | 80(80/80) | (B-1)/(B-3) = 7/3 | — | 15 | 85 | 110,000 |
| 7 | Resin A(7) | (A-2)/(A-10) = 5/5 | 40(40/40) | (B-1)/(B-3) = 5/5 | — | 15 | 85 | 110,000 |
| 8 | Resin A(8) | (A-2)/(A-10) = 5/5 | 40(40/40) | (B-1)/(B-3) = 5/5 | — | 40 | 60 | 90,000 |
| 9 | Resin A(9) | (A-3)/(A-11) = 5/5 | 80(80/80) | (B-1)/(B-3) = 5/5 | — | 10 | 90 | 100,000 |
| 10 | Resin A(10) | (A-3)/(A-11) = 5/5 | 80(80/80) | (B-1)/(B-3) = 5/5 | — | 35 | 65 | 70,000 |
| 11 | Resin A(11) | (A-2)/(A-10) = 3/7 | 40(40/40) | (B-1)/(B-3) = 3/7 | — | 10 | 90 | 80,000 |
| 12 | Resin A(12) | (A-2)/(A-10) = 3/7 | 40(40/40) | (B-1)/(B-3) = 3/7 | — | 40 | 60 | 120,000 |
| 13 | Resin A(13) | (A-3)/(A-11) = 3/7 | 80(80/80) | (B-1)/(B-3) = 3/7 | — | 15 | 85 | 110,000 |
| 14 | Resin A(14) | (A-3)/(A-11) = 3/7 | 80(80/80) | (B-1)/(B-3) = 3/7 | — | 40 | 60 | 120,000 |
| 15 | Resin A(15) | (A-10) | 40 | (B-3) | — | 20 | 80 | 90,000 |
| 16 | Resin A(16) | (A-10) | 40 | (B-3) | — | 30 | 70 | 110,000 |
| 17 | Resin A(17) | (A-11) | 80 | (B-3) | — | 20 | 80 | 100,000 |
| 18 | Resin A(18) | (A-11) | 80 | (B-3) | — | 40 | 60 | 90,000 |
| 19 | Resin A(19) | (A-1)/(A-9) = 3/7 | 20(20/20) | (B-1)/(B-3) = 3/7 | — | 20 | 80 | 130,000 |
| 20 | Resin A(20) | (A-4)/(A-12) = 3/7 | 120(120/120) | (B-1)/(B-3) = 3/7 | — | 25 | 75 | 100,000 |
| 21 | Resin A(21) | (A-13)/(A-17) = 3/7 | 40(40/40) | (B-1)/(B-3) = 3/7 | — | 20 | 80 | 80,000 |
| 22 | Resin A(22) | (A-14)/(A-18) = 3/7 | 80(80/80) | (B-1)/(B-3) = 3/7 | — | 35 | 65 | 100,000 |
| 23 | Resin A(23) | (A-15)/(A-17) = 3/7 | 40(40/40) | (B-2)/(B-3) = 3/7 | — | 15 | 85 | 80,000 |
| 24 | Resin A(24) | (A-16)/(A-18) = 3/7 | 80(80/80) | (B-2)/(B-3) = 3/7 | — | 20 | 80 | 110,000 |
| 25 | Resin A(25) | (A-19)/(A-21) = 3/7 | 40(40/40) | (B-1)/(B-3) = 3/7 | — | 10 | 90 | 90,000 |
| 26 | Resin A(26) | (A-20)/(A-21) = 3/7 | 40(40/40) | (B-2)/(B-3) = 3/7 | — | 40 | 60 | 130,000 |
| 27 | Resin A(27) | (A-2)/(A-10) = 3/7 | 40(40/40) | (B-1)/(B-3) = 3/7 | (C-1)/(C-3) = 3/7 | 10 | 60 | 110,000 |
| 28 | Resin A(28) | (A-2)/(A-6) = 5/5 | 40(40/40) | (B-3) | — | 20 | 80 | 110,000 |
| 29 | Resin A(29) | (A-2)/(A-6) = 3/7 | 40(40/40) | (B-1)/(B-2) = 3/7 | — | 30 | 70 | 100,000 |
| 30 | Resin A(30) | (A-3)/(A-7) = 3/7 | 80(80/80) | (B-1)/(B-2) = 3/7 | — | 30 | 70 | 130,000 |
| 31 | Resin A(31) | (A-2)/(A-6) = 7/3 | 40(40/40) | (B-1)/(B-2) = 3/7 | — | 25 | 75 | 120,000 |
| 32 | Resin A(32) | (A-3)/(A-7) = 7/3 | 80(80/80) | (B-1)/(B-2) = 3/7 | — | 20 | 80 | 110,000 |
| 33 | Resin A(33) | (A-2)/(A-10) = 3/7 | 40(40/40) | (B-1)/(B-3) = 3/7 | — | 6 | 94 | 110,000 |
| 34 | Resin A(34) | (A-6)/(A-10) = 3/7 | 40(40/40) | (B-2)/(B-3) = 3/7 | — | 6 | 94 | 120,000 |

TABLE 1-continued

| Synthesis example | Polyester resin A | Formula (A) Structural unit | Formula (A) Average value of n | Formula (B) | Formula (C) | Content of formula (A) | Content of formula (B) | Weight average molecular weight |
|---|---|---|---|---|---|---|---|---|
| 35 | Resin A(35) | (A-2)/(A-3)/(A-10)/(A-11) = 2.25/0.75/5.25/1.75 | 50(40/80/40/80) | (B-1)/(B-3) = 3/7 | — | 6 | 94 | 110,000 |
| 36 | Resin A(36) | (A-6)/(A-7)/(A-10)/(A-11) = 2.25/0.75/5.25/1.75 | 50(40/80/40/80) | (B-2)/(B-3) = 3/7 | — | 6 | 94 | 120,000 |
| 37 | Resin A(37) | (A-2)/(A-3)/(A-10)/(A-11) = 2.25/0.75/5.25/1.75 | 50(40/80/40/80) | (B-1)/(B-3) = 3/7 | — | 10 | 90 | 90,000 |
| 38 | Resin A(38) | (A-6)/(A-7)/(A-10)/(A-11) = 2.25/0.75/5.25/1.75 | 50(40/80/40/80) | (B-2)/(B-3) = 3/7 | — | 10 | 90 | 100,000 |

In Table 1, "Formula (A)" represents a structural unit represented by Formula (A). In the case of mixing the structural units represented by Formula (A) for use, the kinds of structural units and the mixing ratio are described. "Average value of n" represents the average value of n in the polyester resin A (the whole structural units represented by Formula (A)). In the case of mixing the structural units represented by Formula (A) for use, the average value of n for each structural unit used is described in parentheses. "Formula (B)" represents a structural unit represented by Formula (B). In the case of mixing the structural units represented by Formula (B) for use, the kinds of structural units and the mixing ratio are described. "Formula (C)" represents a structural unit represented by Formula (C). In the case of mixing the structural units represented by Formula (C) for use, the kinds of structural units and the mixing ratio are described. "Content of Formula (A)" means the content (% by mass) of the structural unit represented by Formula (A) in the polyester resin A. "Content of Formula (B)" means the content (% by mass) of the structural unit represented by Formula (B) in the polyester resin A.

The charge-transporting layer contains a polyester resin A and at least one resin of a polyester resin C and a polycarbonate resin D. The charge-transporting layer may further contain another resin. Examples of the other resin which may be contained for use include an acrylic resin, a polyester resin, and a polycarbonate resin.

The polyester resin C and the polycarbonate resin D can include no structural unit represented by Formula (A) for efficiently forming a matrix-domain structure.

[Charge-Transporting Substance]

A charge-transporting layer contains a charge-transporting substance. Examples of the charge-transporting substance include a triarylamine compound, a hydrazone compound, a butadiene compound, and an enamine compound. The charge-transporting substances may be used singly or in combination of two or more kinds. In particular, a triarylamine compound can be used as the charge-transporting substance for improving electrophotographic properties. A compound for use as a charge-transporting substance can contain no fluorine atom.

Examples of the charge-transporting substance are described in the followings.

(E-1)

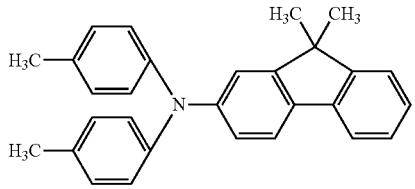

(E-2)

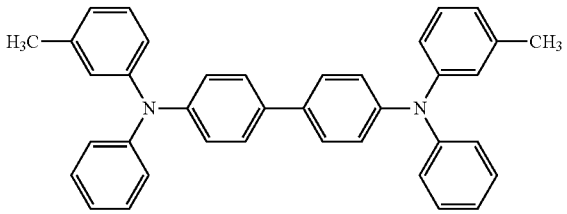

(E-3)

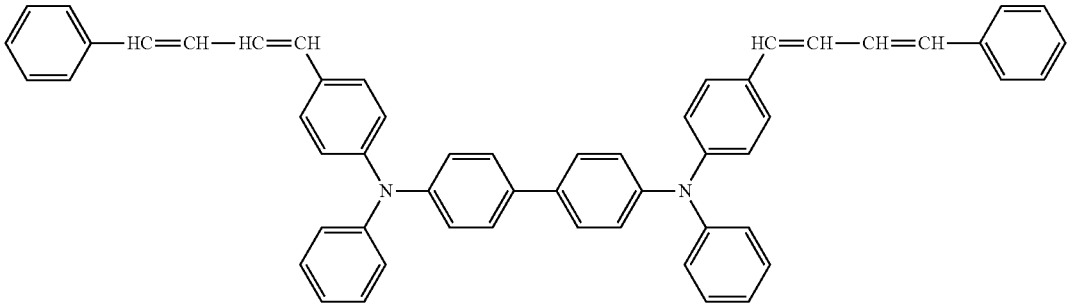

-continued (E-4)

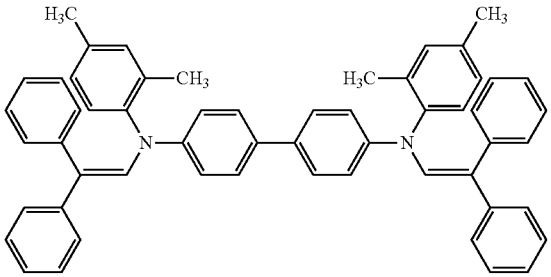

(E-5)

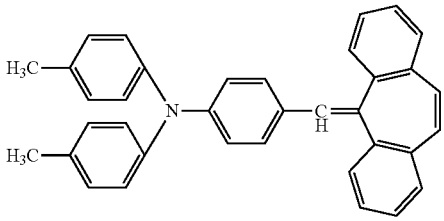

The charge-transporting layer can be formed with a coating film of a charge-transporting layer coating liquid which is obtained by dissolving a polyester resin A, a charge-transporting substance, and at least one resin selected from the group consisting of the polyester resin C and the polycarbonate resin D in a solvent.

The ratio of the charge-transporting substance to the resin can be in the range of 4:10 to 20:10 (mass ratio), more preferably in the range of 5:10 to 12:10 (mass ratio).

Examples of the solvent for use in the charge-transporting layer coating liquid include a ketone solvent, an ester solvent, an ether solvent, and an aromatic hydrocarbon solvent. The solvents can be used singly or in combination of two or more kinds. In particular, an ether solvent or an aromatic hydrocarbon solvent can be used from the view point of solubility of the resin.

The charge-transporting layer can have a film thickness of 5 μm or more and 50 μm or less, more preferably 10 μm or more and 35 μm or less.

An antioxidizing agent, an ultraviolet absorbing agent, a plasticizing agent, and the like may be added to the charge-transporting layer on an as needed basis.

Although a cylindrical electrophotographic photosensitive member having a photosensitive layer (a charge generating-layer and a charge-transporting layer) on a cylindrical support is commonly used, a belt-like or a sheet-like shape may be employed.

The charge-transporting layer of the electrophotographic photosensitive member of the present invention contains a charge-transporting substance. The charge-transporting layer contains the polyester resin A, and at least one resin of the polyester resin C and the polycarbonate resin D.

The charge-transporting layer may include a lamination structure. In that case, at least a charge-transporting layer on the outermost surface side includes the matrix-domain structure.

Although a cylindrical electrophotographic photosensitive member having a photosensitive layer on a cylindrical support is commonly used, a belt-like or a sheet-like shape may be employed.

[Support]

A support having electrical conductivity (conductive support) can be used. A support made of metal such as aluminum, aluminum alloy, and stainless steel can be used. In the case of a support made of aluminum or aluminum alloy, an ED tube, an EI tube, or a support made from the tube which is machined, electro-chemically buffed (electrolysis with an electrode having an electrolytic action and an electrolyte solution and polishing with a grinding stone having a polishing action), or wet or dry honed may be used. Alternatively, a coating of aluminum, aluminum alloy, or indium oxide-tin oxide alloy may be formed on a support made of metal or resin by vacuum deposition. The surface of a support may be machined, roughened, or alumite-treated.

A support of resin impregnated with conductive particles such as carbon black, tin oxide particles, titanium oxide particles, and silver particles, or a plastic having a conductive resin may be also used.

A conductive layer may be arranged between the support and an after-mentioned undercoat layer or a charge-generating layer, in order to reduce interference fringes due to scattering of laser light or to cover a bruise on the support. The conductive layer is formed with a conductive layer coating liquid including dispersed conductive particles in a resin. Examples of the conductive particles include carbon black, acetylene black, powder of metal such as aluminum, nickel, iron, nichrome, copper, zinc, and silver, and powder of metal oxide such as conductive tin oxide and ITO.

Examples of the resin for use in the conductive layer include a polyester resin, a polycarbonate resin, a polyvinyl butyral resin, an acrylic resin, a silicone resin, an epoxy resin, a melamine resin, an urethane resin, a phenol resin, and an alkyd resin.

Examples of the solvent for the conductive layer coating liquid include an ether solvent, an alcohol solvent, a ketone solvent, and an aromatic hydrocarbon solvent.

The conductive layer can have a film thickness of 0.2 μm or more and 40 μm or less, more preferably 1 μm or more and 35 μm or less, further more preferably 5 μm or more and 30 μm or less.

An undercoat layer may be arranged between a support or a conductive layer and a charge-generating layer.

The undercoat layer can be formed by applying an undercoat layer coating liquid which contains resin on the conductive layer, and by drying or curing the applied coating liquid.

Examples of the resin for use in the undercoat layer include polyacrylic acids, methyl cellulose, ethyl cellulose, a polyamide resin, a polyimide resin, a poly amide-imide resin, a polyamide acid resin, a melamine resin, an epoxy resin, a polyurethane resin, and a polyolefin resin. A thermoplastic resin can be used as the resin of the undercoat layer. Specifically, a thermoplastic polyamide resin or polyolefin resin can be suitable for use. Examples of the polyamide resin include a low-crystalline or non-crystalline copolymerized nylon applicable in a solution state. The polyolefin resin in a particle dispersion liquid sate can be usable. The polyolefin resin dispersed in an aqueous solvent can be more preferably used.

The undercoat layer can have a film thickness of 0.05 μm or more and 7 μm or less, more preferably 0.1 μm or more and 2 μm or less.

The undercoat layer may contain semiconductor particles, an electron-transporting substance, or an electron accepting substance.

[Charge-Generating Layer]

A charge-generating layer is arranged on a support, a conductive layer or an undercoat layer.

Examples of the charge-generating substance for use in the electrophotographic photosensitive member of the present invention include an azo pigment, a phthalocyanine pigment, an indigo pigment and a perylene pigment. The charge-generating substances may be used singly or in combination of two or more kinds. In particular, a metal phthalocyanine such as oxytitanium phthalocyanine, hydroxygallium phthalocyanine and chlorogallium phthalocyanine can be suitably used, having high sensitivity.

Examples of the resin used for the charge-generating layer include a polycarbonate resin, a poly ester resin, a butyral resin, a polyvinyl acetal resin, an acrylic resin, a vinyl acetate resin and a urea formaldehyde resin. In particular, a butyral resin can be suitably used. The resins can be used singly or in combination of two or more kinds as a mixture or a copolymer.

The charge-generating layer can be formed by applying a charge-generating layer coating liquid which contains a dispersed charge-generating substance with a resin and a solvent, and by drying the produced coating film. Alternatively, the charge-generating layer may be a vapor-deposited film of a charge-generating substance.

Examples of the dispersion method include a method using a homogenizer, ultrasonic waves, a ball mill, a sand mill, an attritor, or a roll mill.

The ratio of the charge-generating substance to the resin can be in the range of 1:10 to 10:1 (mass ratio), more preferably in the range of 1:1 to 3:1 (mass ratio).

Examples of the solvent for use in the charge-generating layer coating liquid include an alcohol solvent, a sulfoxide solvent, a ketone solvent, an ether solvent, an ester solvent, and an aromatic hydrocarbon solvent.

The charge-generating layer can have a film thickness of 0.01 μm or more and 5 μm or less, more preferably 0.1 μm or more and 2 μm or less.

Various sensitizers, antioxidizing agents, ultraviolet absorbing agents, plasticizing agents, and the like may be added to the charge-generating layer on an as needed basis. In order to prevent a charge flow from stagnating in the charge-generating layer, an electron-transporting substance or an electron-accepting substance may be contained in the charge-generating layer.

The charge-transporting layer is arranged on the charge-generating layer.

Various additives can be added to each layer of the electrophotographic photosensitive member. Examples of the additives include a degradation prevention agent such as an antioxidizing agent, an ultraviolet absorbing agent, and a light stabilizer, and fine particles such as organic fine particles and inorganic fine particles. Examples of the degradation prevention agent include a hindered phenol antioxidizing agent, a hindered amine light stabilizer, a sulfur atom-containing antioxidizing agent, and a phosphor atom-containing antioxidizing agent. Examples of the organic fine particles include polymer resin particles such as fluorine atom-containing resin particles, polystyrene fine particles, polyethylene resin particles. Examples of the inorganic fine particles include a metal oxide such as silica and alumina.

The coating liquid for each layer can be applied by an application method such as an immersion application method (an immersion coating method), a spray coating method, a spinner coating method, a roller coating method, a Mayer bar coating method, and a blade coating method.

A concavo-convex shape (a concave shape and a convex shape) may be formed on the surface of the charge-transporting layer which is the surface layer of an electrophotographic photosensitive member. The concavo-convex shape can be formed by a known method. Examples of the forming method include a method for forming a concave shape by spraying abrasive particles to the surface of the charge-transporting layer, a method for forming a concavo-convex shape by pressure-contacting the surface of the charge-transporting layer with a mold having a concavo-convex shape, a method for forming a concave shape by condensing dew on the surface of a coating film formed by applying a surface layer coating liquid and then by drying the dew, and a method for forming a concave shape by irradiating the surface of the charge-transporting layer with laser light. In particular, a method for forming a concavo-convex shape by pressure-contacting the surface of the electrophotographic photosensitive member with a mold having a concavo-convex shape can be suitably used. A method for forming a concave shape by condensing dew on the surface of a coating film formed by applying a surface layer coating liquid and then by drying the dew can be also suitably used.

[Electrophotographic Apparatus]

A schematic view of an electrophotographic apparatus provided with a process cartridge having an electrophotographic photosensitive member is illustrated in FIGURE.

In FIGURE, a cylindrical electrophotographic photosensitive member 1 is rotary-driven around a central shaft 2 in the direction of arrow at a predetermined circumferential velocity. The surface of the rotary-driven electrophotographic photosensitive member 1 is uniformly electrified at a predetermined positive or negative potential with a charging unit 3 (primary charging unit: charging roller and the like) in a rotation process. The surface is then exposed to exposure light (image exposure light) 4 outputted from an exposure unit (not illustrated in drawing) such as slit exposure and laser beam scanning exposure. An electrostatic latent image corresponding to an object image is thus sequentially formed on the surface of the electrophotographic photosensitive member 1.

The electrostatic latent image formed on the surface of the electrophotographic photosensitive member 1 is developed into a toner image through reversal development with a toner contained in the developer of a developing unit 5. The toner image formed and carried on the surface of the electrophotographic photosensitive member 1 is sequentially transferred to a transfer material (paper or the like) P with transfer bias from a transferring unit (transfer roller or the like) 6. The transfer material P is taken out for feeding from a transfer material supply unit (not illustrated in drawing) in synchronization with the rotation of the electrophotographic photosensitive member 1 between the electrophotographic photosensitive member 1 and the transferring unit 6 (contact part).

The transfer material P having a transferred toner image is separated from the surface of the electrophotographic photosensitive member 1 to be led to a fixation unit 8 for fixation of the image. An image formed object (a print or a copy) is thus printed out to the outside of the apparatus.

After transfer of the toner image, the surface of the electrophotographic photosensitive member 1 is cleaned with a cleaning unit (cleaning blade or the like) 7 for removal of the developer (toner) remaining after transfer. The surface is then electrically neutralized with pre-exposure light (not illustrated in drawing) from a pre-exposure unit (not illustrated in drawing) for use in repeating image formation. As illustrated in FIGURE, in the case that the charging unit 3 is a contact charging unit using a charging roller or the like, the pre-exposure is not necessarily required.

A plurality of components including an electrophotographic photosensitive member 1, a charging unit 3, a developing unit 5, a transferring unit 6, and a cleaning unit 7 can be housed in a container so as to integrally combined into a process cartridge. The process cartridge may be detachably attached to an electrophotographic apparatus body. In FIGURE, an electrophotographic photosensitive member 1, a charging unit 3, a developing unit 5, and a cleaning unit 7 are integrally supported to form a process cartridge 9, which is detachably attached to an electrophotographic apparatus body using a guide unit 10 such as a rail of the electrophotographic apparatus body.

EXAMPLES

The following Examples further illustrate the present invention in detail. However, the present invention is not limited thereto. In the Examples, "part" means "mass part".

Example 1

An aluminum cylinder with a diameter of 24 mm and a length of 257 mm was used as a support (conductive support).

A conductive layer coating liquid was then prepared from 10 parts of barium sulfate particles coated with $SnO_2$ (conductive particles), 2 parts of titanium oxide particles (pigment for adjusting resistance), 6 parts of a phenol resin, 0.001 parts of a silicone oil (leveling agent), and a mixed solvent of 4 parts of methanol/16 parts of methoxypropanol.

The conductive layer coating liquid was applied to the support by immersion coating and cured (thermally cured) at 140° C. for 30 minutes. A conductive layer with a film thickness of 15 μm was thus formed.

An undercoat layer coating liquid was then prepared by dissolving 3 parts of N-methoxymethylated nylon and 3 parts of copolymerized nylon in a mixed solvent of 65 parts of methanol/30 parts of n-butanol.

The undercoat layer coating liquid was applied to the conductive layer by immersion coating and dried at 100° C. for 10 minutes. An undercoat layer with a film thickness of 0.7 μm was thus formed.

Subsequently, 10 parts of hydroxygallium phthalocyanine (charge-generating substance) in a crystalline form having strong peaks at Bragg angles) (2θ±0.2° of 7.5°, 9.9°, 16.3°, 18.6°, 25.1° and 28.3° in CuKα characteristic X-ray diffraction were prepared, to which 250 parts of cyclohexanone and 5 parts of a polyvinyl butyral resin (brand name: S-LEC BX-1 made by Sekisui Chemical Co., Ltd.) were mixed and dispersed under atmosphere at 23±3° C. for 1 hour with a sand mill using glass beads with a diameter of 1 mm. After dispersion, 250 parts of ethyl acetate was added to prepare a charge-generating layer coating liquid. The charge-generating layer coating liquid was applied to the undercoat layer by immersion coating. The produced coating film was dried at 100° C. for 10 minutes. A charge-generating layer with a film thickness of 0.26 μm was thus formed.

Subsequently, 9 parts of a compound (charge-transporting substance) represented by Formula (E-1), 1 parts of a compound (charge-transporting substance) represented by Formula (E-2), 3 parts of a resin A(1) synthesized in synthesis example 1, and 7 parts of a polyester resin C (containing a structural unit represented by Formula (C-1) and a structural unit represented by Formula (C-2) in a ratio of 5:5, having a weight average molecular weight of 120,000) were dissolved in a mixed solvent of 30 parts of dimethoxymethane and 50 parts of ortho-xylene for preparation of a charge-transporting layer coating liquid. The charge-transporting layer coating liquid was applied to the charge-generating layer by immersion coating. The produced coating film was dried at 120° C. for 1 hour. A charge-transporting layer with a film thickness of 16 μm was thus formed. The produced charge-transporting layer was confirmed to have a domain structure which contains a polyester resin A in a matrix which contains the charge-transporting substance and the polyester resin C.

An electrophotographic photosensitive member having a charge-transporting layer as the surface layer was thus manufactured. The compositions of charge-transporting substances and the resins which are contained in a charge-transporting layer are described in Table 2.

Evaluation is described in the followings.

Evaluation was performed on variation of the bright part potential (potential variation) in repeating use for 3,000 sheets, photo memory, relative values of initial torque and torque after repeating use for 3,000 sheets, and observation of the surface of an electrophotographic photosensitive member during torque measurement.

<Evaluation of Potential Variation>

A laser beam printer LBP-5050 made by Canon Inc. was used as an evaluation device. The evaluation was performed in an environment with a temperature of 23° C. and a relative humidity of 50%. The exposure value (image exposure value) from a laser source at 780 nm of the evaluation device was configured such that the surface of an electrophotographic photosensitive member has a light intensity of 0.3 $\mu J/cm^2$. The surface potential (dark part potential and bright part potential) of an electrophotographic photosensitive member was measured at a developing unit position, by replacing a developing unit with a jig having a potential measurement probe fixed at a position 130 mm apart from the edge of the electrophotographic photosensitive member. The dark part potential of the non-exposure part of an electrophotographic photosensitive member was set at −450 V. The bright part potential was measured with laser irradiation for optical attenuation from the dark part potential. Using plain A4 size paper, the variation in the bright part potential before and after continuous image outputs for 3,000 sheets was evaluated. A test chart having a coverage rate of 5% was used. The results are described in the potential variation in Table 7.

<Evaluation of Photo Memory>

Under the same conditions as in the evaluation of potential variation, a portion of an electrophotographic photosensitive member was irradiated with light of 3,000 Lux for 25 minutes from a white fluorescent lamp. After standing still for 5 minutes, the bright part potential was measured. The difference in the bright part potential before and after irradiation with light was measured for the evaluation of photo memory. The larger the value, the more photo memories exist. The results are described in the photo memory in Table 6.

<Evaluation of Relative Value of Torque>

Under the same conditions as in the evaluation of potential variation, the drive current value (current value A) of the rotary motor for an electrophotographic photosensitive member was measured for the evaluation of the amount of contact stress between an electrophotographic photosensitive member and a cleaning blade. The measured current value represents the amount of contact stress between an electrophotographic photosensitive member and a cleaning blade.

A control electrophotographic photosensitive member for the relative value of torque was made by the following method. The polyester resin A(1) for use as the resin for the charge-transporting layer of the electrophotographic photosensitive member in Example 1 was replaced with a polyester resin C which contains a structural unit represented by Formula (C-1) and a structural unit represented by Formula (C-2)

in a ratio of 5:5. In other words, an electrophotographic photosensitive member was manufactured as in Example 1 except for the change in resin composition to the polyester resin C only, for use as the control electrophotographic photosensitive member.

Using the manufactured control electrophotographic photosensitive member, the drive current value (current value B) of the rotary motor for an electrophotographic photosensitive member was measured as in Example 1.

The ratio of the measured drive current value (current value A) of the rotary motor for an electrophotographic photosensitive member which contains a polyester resin A to the measured drive current value (current value B) of the rotary motor for an electrophotographic photosensitive member which contains no polyester resin A was calculated. The obtained values of (current value A)/(current value B) were compared as the relative values of torque. The relative value of torque represents the degree of reduction in the amount of contact stress between the electrophotographic photosensitive member and a cleaning blade due to the use of polyester resin A. The smaller the relative value of torque, the larger the degree of reduction in the amount of contact stress between the electrophotographic photosensitive member and a cleaning blade is. The results are described in the relative value of initial torque in Table 7.

Using plain A4 size paper, continuous image output for 3,000 sheets was performed. A test chart having a coverage rate of 5% was used. The relative value of torque after repeating use for 3,000 sheets was then measured. The relative value of torque after repeating use for 3,000 sheets was evaluated in a similar manner as for the relative value of initial torque. In this case, the drive current value of the rotary motor after repeating use of the control electrophotographic photosensitive member for 3,000 sheets was used to calculate the relative value of torque after repeating use for 3,000 sheets. The results are described in the relative value of torque after use for 3,000 sheets in Table 7.

<Evaluation of Matrix-Domain Structure>

The charge-transporting layer of the electrophotographic photosensitive member manufactured by the method was cut in the vertical direction of the charge-transporting layer to form a cross section, of which observation was performed with an ultra-high depth shape measurement microscope VK-9500 (made by Keyence Corporation). In this occasion, the maximum sizes of the randomly selected 100 domains formed in a visual field of 100 μm square (10,000 $\mu m^2$) on the surface of the electrophotographic photosensitive member are measured with an object lens magnification of 50. The average value was calculated from the obtained maximum sizes so as to obtain the number average particle size. The results are described in Table 7.

Examples 2 to 53

An electrophotographic photosensitive member was manufactured for evaluation as in Example 1 except for the change in the resin and a charge-transporting substance for the charge-transporting layer to those described in Table 2. The formed charge-transporting layer was confirmed to contain a domain which includes a polyester resin A in a matrix which includes a charge-transporting substance and a polyester resin C. The results are described in Table 7. The weight average molecular weight of the polyester resin C was as follows.

(C-1)/(C-2)=5/5:120,000
(C-3):100,000
(C-4)/(C-5)=3/7:110,000
(C-6):120,000
(C-7)/(C-8)=5/5:110,000
(C-10)/(C-11)=5/5:100,000

Examples 54 to 79

An electrophotographic photosensitive member was manufactured for evaluation as in Example 1 except for the change in the resin for the charge-transporting layer from a polyester resin C to a polycarbonate resin D so as to use a polyester resin A and a polycarbonate resin D as respectively described in Table 3. The formed charge-transporting layer was confirmed to contain a domain which includes a polyester resin A in a matrix which includes a charge-transporting substance and a polycarbonate resin D. The results are described in Table 8. The weight average molecular weight of the polycarbonate resin D was as follows.

(D-1):140,000
(D-5):160,000
(D-6):130,000
(D-7):140,000
(D-8):130,000

Examples 80 to 100

The charge-transporting substance, the polyester resin A, and the polyester resin C or the polycarbonate resin D of a charge-transporting layer were changed to those as respectively described in Table 4. An electrophotographic photosensitive member was manufactured for evaluation as in Example 1 except for the further change in the mixed solvent used for the charge-transporting layer coating liquid to 40 parts of tetrahydrofuran and 40 parts of toluene. The formed charge-transporting layer was confirmed to contain a domain which includes a polyester resin A in a matrix which includes a charge-transporting substance and a polyester resin C or a polycarbonate resin D. The results are described in Table 9. The weight average molecular weight of the polyester resin C or the polycarbonate resin D was as follows.

(C-4)/(C-5)=3/7:110,000
(C-5):110,000
(C-9):100,000
(C-12):130,000
(D-2):130,000
(D-3):160,000
(D-4):120,000

Examples 101 to 108

An electrophotographic photosensitive member was manufactured for evaluation as in Example 1 except for the change in the charge-transporting substance, the polyester resin A, and the polyester resin C or the polycarbonate resin D of a charge-transporting layer to those described in Table 5. The formed charge-transporting layer was confirmed to contain a domain which includes a polyester resin A in a matrix which includes a charge-transporting substance and a polyester resin C or a polycarbonate resin D. The results are described in Table 10. The weight average molecular weight of the polyester resin C or the polycarbonate resin D was as follows.

(C-7)/(C-8)=3/7:120,000
(C-7)/(C-8)=7/3:130,000
(D-1):140,000

Examples 109 to 120

An electrophotographic photosensitive member was manufactured for evaluation as in Example 1 except for the change in the resin and the charge-transporting substance for the charge-transporting layer to those described in Table 13. The formed charge-transporting layer was confirmed to contain a domain which includes a polyester resin A in a matrix which includes a charge-transporting substance and a polyester resin C. The results are described in Table 14. The weight average molecular weight of the polyester resin C was as follows.

(C-1)/(C-2)=5/5:120,000

(C-1)/(C-3)=3/7:100,000

Comparative Examples

A polyester resin F (resins F(1) to F(7)) was used in the following Comparative Examples as a comparative resin as described in the following Table 12. The polyester resin F includes a structural unit represented by a formula (F-3) or a formula (F-4) described in the following.

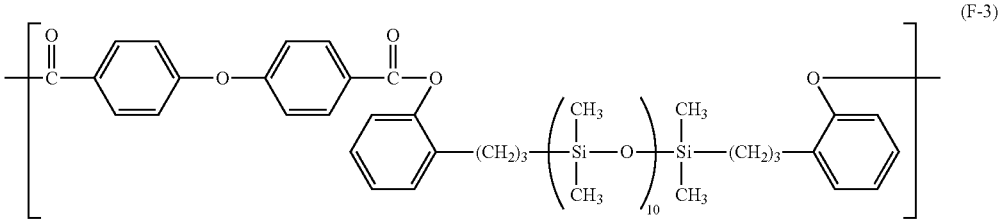

(F-3)

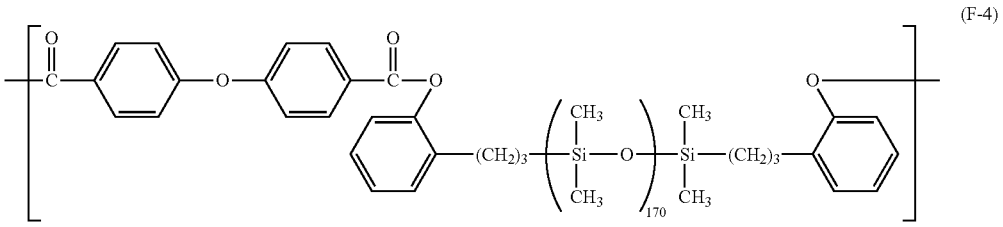

(F-4)

Comparative Example 1

An electrophotographic photosensitive member was manufactured as in Example 1 except for the change in the resin from the polyester resin A(1) to the polyester resin C containing a structural unit represented by Formula (C-1) and a structural unit represented by Formula (C-2) in a ratio of 5:5. The formed charge-transporting layer was not confirmed to include a matrix-domain structure. The evaluation was performed as in Example 1. The results are described in Table 11.

Comparative Examples 2 to 5

An electrophotographic photosensitive member was manufactured as in Example 1 except for the change from the polyester resin A to the polyester resin C or the polycarbonate resin D described in Table 6 in Examples 8, 53, 84 and 97. In Comparative Example 4 and Comparative Example 5, however, the mixed solvent for the charge-transporting layer coating liquid was changed to 40 parts of tetrahydrofuran and 40 parts of toluene. The compositions of the charge-transporting substance and the resin contained in the charge-transporting layer are described in Table 5. The formed charge-transporting layer was not confirmed to include a matrix-domain structure. The evaluation was performed as in Example 1. The results are described in Table 11.

Comparative Examples 6 to 8

An electrophotographic photosensitive member was manufactured as in Example 1 except for the change from the polyester resin A to the polyester resin F(1) and the change from the charge-transporting substance and the polyester resin C or the polycarbonate resin D to those described in Table 6 in Example 1. In Comparative Example 8, however, the mixed solvent used for the charge-transporting layer coating liquid was changed to 40 parts of tetrahydrofuran and 40 parts of toluene. The formed charge-transporting layer was not confirmed to include a matrix-domain structure. The evaluation was performed as in Example 1. The results are described in Table 11.

Comparative Examples 9 to 11

An electrophotographic photosensitive member was manufactured as in Example 1 except for the change from the polyester resin A to the polyester resin F(2) and the change from the charge-transporting substance and the polyester resin C to those described in Table 6 in Example 1. In Comparative Example 11, however, the mixed solvent used for the charge-transporting layer coating liquid was changed to 40 parts of tetrahydrofuran and 40 parts of toluene. Although the formed charge-transporting layer was confirmed to include a matrix-domain structure, the polyester resin A localized at the interface between a charge-transporting layer and a charge generating layer. The evaluation was performed as in Example 1. The results are described in Table 11.

Comparative Examples 12 to 14

An electrophotographic photosensitive member was manufactured as in Example 1 except for the change from the polyester resin A to the polyester resin F(3) and the change from the charge-transporting substance and the polyester resin C to those described in Table 6 in Example 1. In Comparative Example 14, however, the mixed solvent used for the charge-transporting layer coating liquid was changed to 40 parts of tetrahydrofuran and 40 parts of toluene. The formed charge-transporting layer was not confirmed to include a matrix-domain structure. The evaluation was performed as in Example 1. The results are described in Table 11.

Comparative Examples 15 to 17

An electrophotographic photosensitive member was manufactured as in Example 1 except for the change from the polyester resin A to the polyester resin F(4) and the change from the charge-transporting substance and the polyester resin C to those described in Table 6 in Example 1. In Comparative Example 17, however, the mixed solvent used for the charge-transporting layer coating liquid was changed to 40 parts of tetrahydrofuran and 40 parts of toluene. Although the formed charge-transporting layer was confirmed to include a matrix-domain structure, the polyester resin A localized at the interface between a charge-transporting layer and a charge generating layer. The evaluation was performed as in Example 1. The results are described in Table 11.

Comparative Examples 18 to 20

An electrophotographic photosensitive member was manufactured as in Example 1 except for the change from the polyester resin A to the polyester resin F(5) and the change from the charge-transporting substance and the polyester resin C to those described in Table 6 in Example 1. In Comparative Example 20, however, the mixed solvent for the charge-transporting layer coating liquid was changed to 40 parts of tetrahydrofuran and 40 parts of toluene. The formed charge-transporting layer was confirmed to include a matrix-domain structure. The evaluation was performed as in Example 1. The results are described in Table 11.

Comparative Examples 21 to 23

An electrophotographic photosensitive member was manufactured as in Example 1 except for the change from the polyester resin A to the polyester resin F(6) and the change from the charge-transporting substance and the polyester resin C to those described in Table 6 in Example 1. In Comparative Example 23, however, the mixed solvent for the charge-transporting layer coating liquid was changed to 40 parts of tetrahydrofuran and 40 parts of toluene. The formed charge-transporting layer was confirmed to include a matrix-domain structure. The evaluation was performed as in Example 1. The results are described in Table 11.

Comparative Example 24

An electrophotographic photosensitive member was manufactured as in Example 1 except for the change from the polyester resin C to the polyester resin F(7) having the same composition as of the polyester resin A(1) in Example 1, so that the resin contained in the charge-transporting layer was the polyester resin F(7) only. The formed charge-transporting layer was not confirmed to include a matrix-domain structure. The evaluation was performed as in Example 1. The results are described in Table 11.

TABLE 2

| | Charge-transporting substance | Polyester resin A | Polyester resin C | Mixing ratio |
|---|---|---|---|---|
| Example 1 | (E-1)/(E-2) = 9/1 | Resin A(1) | (C-1)/(C-2) = 5/5 | 3/7 |
| Example 2 | (E-1)/(E-2) = 9/1 | Resin A(2) | (C-1)/(C-2) = 5/5 | 3/7 |
| Example 3 | (E-1)/(E-2) = 9/1 | Resin A(3) | (C-1)/(C-2) = 5/5 | 3/7 |

TABLE 2-continued

| | Charge-transporting substance | Polyester resin A | Polyester resin C | Mixing ratio |
|---|---|---|---|---|
| Example 4 | (E-1)/(E-2) = 9/1 | Resin A(4) | (C-1)/(C-2) = 5/5 | 3/7 |
| Example 5 | (E-1)/(E-2) = 9/1 | Resin A(5) | (C-1)/(C-2) = 5/5 | 3/7 |
| Example 6 | (E-1)/(E-2) = 9/1 | Resin A(6) | (C-1)/(C-2) = 5/5 | 3/7 |
| Example 7 | (E-1)/(E-2) = 9/1 | Resin A(7) | (C-1)/(C-2) = 5/5 | 3/7 |
| Example 8 | (E-1)/(E-2) = 9/1 | Resin A(7) | C-3 | 3/7 |
| Example 9 | (E-1)/(E-2) = 9/1 | Resin A(7) | (C-4)/(C-5) = 3/7 | 3/7 |
| Example 10 | (E-1)/(E-2) = 9/1 | Resin A(8) | (C-1)/(C-2) = 5/5 | 3/7 |
| Example 11 | (E-1)/(E-2) = 9/1 | Resin A(8) | (C-4)/(C-5) = 3/7 | 3/7 |
| Example 12 | (E-1)/(E-2) = 9/1 | Resin A(8) | C-6 | 3/7 |
| Example 13 | (E-1)/(E-2) = 9/1 | Resin A(9) | (C-1)/(C-2) = 5/5 | 3/7 |
| Example 14 | (E-1)/(E-2) = 9/1 | Resin A(9) | (C-4)/(C-5) = 3/7 | 3/7 |
| Example 15 | (E-1)/(E-2) = 9/1 | Resin A(9) | (C-7)/(C-8) = 5/5 | 3/7 |
| Example 16 | (E-1)/(E-2) = 9/1 | Resin A(10) | (C-1)/(C-2) = 5/5 | 3/7 |
| Example 17 | (E-1)/(E-2) = 9/1 | Resin A(10) | (C-4)/(C-5) = 3/7 | 3/7 |
| Example 18 | (E-1)/(E-2) = 9/1 | Resin A(10) | (C-7)/(C-8) = 5/5 | 3/7 |
| Example 19 | (E-1)/(E-2) = 9/1 | Resin A(11) | (C-1)/(C-2) = 5/5 | 3/7 |
| Example 20 | (E-1)/(E-2) = 9/1 | Resin A(11) | (C-1)/(C-2) = 5/5 | 2/8 |
| Example 21 | (E-1)/(E-2) = 9/1 | Resin A(11) | C-3 | 3/7 |
| Example 22 | (E-1)/(E-2) = 9/1 | Resin A(11) | (C-7)/(C-8) = 5/5 | 3/7 |
| Example 23 | (E-1)/(E-2) = 9/1 | Resin A(12) | (C-1)/(C-2) = 5/5 | 3/7 |
| Example 24 | (E-1)/(E-2) = 9/1 | Resin A(12) | (C-1)/(C-2) = 5/5 | 2/8 |
| Example 25 | (E-1)/(E-2) = 9/1 | Resin A(12) | C-3 | 3/7 |
| Example 26 | (E-1)/(E-2) = 9/1 | Resin A(12) | (C-7)/(C-8) = 5/5 | 3/7 |
| Example 27 | (E-1)/(E-2) = 9/1 | Resin A(13) | (C-1)/(C-2) = 5/5 | 3/7 |
| Example 28 | (E-1)/(E-2) = 9/1 | Resin A(13) | (C-1)/(C-2) = 5/5 | 1/9 |
| Example 29 | (E-1)/(E-2) = 9/1 | Resin A(13) | (C-4)/(C-5) = 3/7 | 3/7 |
| Example 30 | (E-1)/(E-2) = 9/1 | Resin A(13) | (C-7)/(C-8) = 5/5 | 3/7 |
| Example 31 | (E-1)/(E-2) = 9/1 | Resin A(14) | (C-1)/(C-2) = 5/5 | 3/7 |
| Example 32 | (E-1)/(E-2) = 9/1 | Resin A(14) | (C-4)/(C-5) = 3/7 | 3/7 |
| Example 33 | (E-1)/(E-2) = 9/1 | Resin A(14) | (C-7)/(C-8) = 5/5 | 3/7 |
| Example 34 | (E-1)/(E-2) = 9/1 | Resin A(15) | (C-1)/(C-2) = 5/5 | 3/7 |
| Example 35 | (E-1)/(E-2) = 9/1 | Resin A(15) | (C-7)/(C-8) = 5/5 | 3/7 |
| Example 36 | (E-1)/(E-2) = 9/1 | Resin A(16) | (C-1)/(C-2) = 5/5 | 3/7 |
| Example 37 | (E-1)/(E-2) = 9/1 | Resin A(16) | C-3 | 3/7 |
| Example 38 | (E-1)/(E-2) = 9/1 | Resin A(17) | (C-1)/(C-2) = 5/5 | 3/7 |
| Example 39 | (E-1)/(E-2) = 9/1 | Resin A(17) | (C-7)/(C-8) = 5/5 | 3/7 |
| Example 40 | (E-1)/(E-2) = 9/1 | Resin A(18) | (C-1)/(C-2) = 5/5 | 3/7 |
| Example 41 | (E-1)/(E-2) = 9/1 | Resin A(18) | (C-10)/(C-11) = 5/5 | 3/7 |
| Example 42 | (E-1)/(E-2) = 9/1 | Resin A(19) | (C-1)/(C-2) = 5/5 | 3/7 |
| Example 43 | (E-1)/(E-2) = 9/1 | Resin A(19) | (C-1)/(C-2) = 5/5 | 4/6 |
| Example 44 | (E-1)/(E-2) = 9/1 | Resin A(20) | (C-1)/(C-2) = 5/5 | 3/7 |
| Example 45 | (E-1)/(E-2) = 9/1 | Resin A(21) | (C-1)/(C-2) = 5/5 | 3/7 |
| Example 46 | (E-1)/(E-2) = 9/1 | Resin A(22) | (C-1)/(C-2) = 5/5 | 3/7 |
| Example 47 | (E-1)/(E-2) = 9/1 | Resin A(23) | (C-1)/(C-2) = 5/5 | 3/7 |
| Example 48 | (E-1)/(E-2) = 9/1 | Resin A(24) | (C-1)/(C-2) = 5/5 | 3/7 |
| Example 49 | (E-1)/(E-2) = 9/1 | Resin A(25) | (C-1)/(C-2) = 5/5 | 3/7 |
| Example 50 | (E-1)/(E-2) = 9/1 | Resin A(26) | (C-1)/(C-2) = 5/5 | 3/7 |
| Example 51 | (E-1)/(E-2) = 9/1 | Resin A(27) | (C-1)/(C-2) = 5/5 | 3/7 |
| Example 52 | (E-1)/(E-2) = 9/1 | Resin A(27) | C-3 | 3/7 |
| Example 53 | (E-1)/(E-2) = 9/1 | Resin A(28) | (C-1)/(C-2) = 5/5 | 3/7 |

TABLE 3

| | Charge-transporting substance | Polyester resin A | Polycarbonate resin D | Mixing ratio |
|---|---|---|---|---|
| Example 54 | (E-1)/(E-2) = 9/1 | Resin A(1) | D-1 | 3/7 |
| Example 55 | (E-1)/(E-2) = 9/1 | Resin A(3) | D-1 | 3/7 |
| Example 56 | (E-1)/(E-2) = 9/1 | Resin A(5) | D-1 | 3/7 |
| Example 57 | (E-1)/(E-2) = 9/1 | Resin A(6) | D-1 | 3/7 |
| Example 58 | (E-1)/(E-2) = 9/1 | Resin A(7) | D-1 | 3/7 |
| Example 59 | (E-1)/(E-2) = 9/1 | Resin A(7) | D-5 | 3/7 |
| Example 60 | (E-1)/(E-2) = 9/1 | Resin A(8) | D-1 | 3/7 |
| Example 61 | (E-1)/(E-2) = 9/1 | Resin A(8) | D-6 | 3/7 |
| Example 62 | (E-1)/(E-2) = 9/1 | Resin A(9) | D-1 | 3/7 |
| Example 63 | (E-1)/(E-2) = 9/1 | Resin A(10) | D-1 | 3/7 |
| Example 64 | (E-1)/(E-2) = 9/1 | Resin A(11) | D-1 | 3/7 |
| Example 65 | (E-1)/(E-2) = 9/1 | Resin A(11) | D-1 | 2/8 |
| Example 66 | (E-1)/(E-2) = 9/1 | Resin A(12) | D-1 | 3/7 |

TABLE 3-continued

| | Charge-transporting substance | Polyester resin A | Poly-carbonate resin D | Mixing ratio |
|---|---|---|---|---|
| Example 67 | (E-1)/(E-2) = 9/1 | Resin A(12) | D-1 | 2/8 |
| Example 68 | (E-1)/(E-2) = 9/1 | Resin A(13) | D-1 | 3/7 |
| Example 69 | (E-1)/(E-2) = 9/1 | Resin A(14) | D-1 | 3/7 |
| Example 70 | (E-1)/(E-2) = 9/1 | Resin A(15) | D-1 | 3/7 |
| Example 71 | (E-1)/(E-2) = 9/1 | Resin A(15) | D-7 | 3/7 |
| Example 72 | (E-1)/(E-2) = 9/1 | Resin A(16) | D-1 | 3/7 |
| Example 73 | (E-1)/(E-2) = 9/1 | Resin A(16) | D-8 | 3/7 |
| Example 74 | (E-1)/(E-2) = 9/1 | Resin A(17) | D-1 | 3/7 |
| Example 75 | (E-1)/(E-2) = 9/1 | Resin A(18) | D-1 | 3/7 |
| Example 76 | (E-1)/(E-2) = 9/1 | Resin A(21) | D-1 | 3/7 |
| Example 77 | (E-1)/(E-2) = 9/1 | Resin A(23) | D-1 | 3/7 |
| Example 78 | (E-1)/(E-2) = 9/1 | Resin A(25) | D-1 | 3/7 |
| Example 79 | (E-1)/(E-2) = 9/1 | Resin A(27) | D-1 | 3/7 |

TABLE 4

| | Charge-transporting substance | Polyester resin A | Polyester resin C or Poly-carbonate resin D | Mixing ratio |
|---|---|---|---|---|
| Example 80 | E-3 | Resin A(11) | (C-4)/(C-5) = 3/7 | 3/7 |
| Example 81 | E-3 | Resin A(11) | C-5 | 3/7 |
| Example 82 | E-3 | Resin A(11) | C-9 | 3/7 |
| Example 83 | E-3 | Resin A(11) | C-9 | 2/8 |
| Example 84 | E-3 | Resin A(11) | C-12 | 3/7 |
| Example 85 | E-3 | Resin A(11) | D-2 | 3/7 |
| Example 86 | E-3 | Resin A(12) | C-9 | 3/7 |
| Example 87 | E-3 | Resin A(15) | C-9 | 3/7 |
| Example 88 | E-3 | Resin A(15) | D-2 | 3/7 |
| Example 89 | E-3 | Resin A(15) | D-3 | 3/7 |
| Example 90 | E-3 | Resin A(17) | D-4 | 3/7 |
| Example 91 | E-4 | Resin A(11) | (C-4)/(C-5) = 3/7 | 3/7 |
| Example 92 | E-4 | Resin A(11) | C-5 | 3/7 |
| Example 93 | E-4 | Resin A(11) | C-9 | 3/7 |
| Example 94 | E-4 | Resin A(11) | C-9 | 2/8 |
| Example 95 | E-4 | Resin A(11) | C-12 | 3/7 |
| Example 96 | E-4 | Resin A(11) | D-2 | 3/7 |
| Example 97 | E-4 | Resin A(12) | C-9 | 3/7 |

TABLE 4-continued

| | Charge-transporting substance | Polyester resin A | Polyester resin C or Poly-carbonate resin D | Mixing ratio |
|---|---|---|---|---|
| Example 98 | E-4 | Resin A(15) | C-9 | 3/7 |
| Example 99 | E-4 | Resin A(15) | D-3 | 3/7 |
| Example 100 | E-4 | Resin A(17) | D-4 | 3/7 |

TABLE 5

| | Charge-transporting substance | Polyester resin A | Polyester resin C or Poly-carbonate resin D | Mixing ratio |
|---|---|---|---|---|
| Example 101 | (E-1)/(E-2) = 8/2 | Resin A(29) | (C-7)/(C-8) = 3/7 | 3/7 |
| Example 102 | (E-1)/(E-2) = 8/2 | Resin A(30) | (C-7)/(C-8) = 3/7 | 3/7 |
| Example 103 | (E-1)/(E-2) = 8/2 | Resin A(31) | (C-7)/(C-8) = 7/3 | 3/7 |
| Example 104 | (E-1)/(E-2) = 8/2 | Resin A(32) | (C-7)/(C-8) = 7/3 | 3/7 |
| Example 105 | (E-1)/(E-2) = 8/2 | Resin A(29) | D-1 | 3/7 |
| Example 106 | (E-1)/(E-2) = 8/2 | Resin A(30) | D-1 | 3/7 |
| Example 107 | (E-1)/(E-2) = 8/2 | Resin A(31) | D-1 | 3/7 |
| Example 108 | (E-1)/(E-2) = 8/2 | Resin A(32) | D-1 | 3/7 |

In Tables 2 to 5, "Charge-transporting substance" represents the charge-transporting substance contained in the charge-transporting layer in Examples, indicating the kind of charge-transporting substances and a mixing ratio in the case of mixed use of charge-transporting substances. In Tables 2 to 5, "Polyester resin C or polycarbonate resin D" represents a structural unit represented by Formulas (C-1) to (C-12), or (D-1) to (D-8) of the polyester resin C or the polycarbonate resin D for use in Examples. In Tables 2 to 5, "Mixing ratio" represents the mixing ratio of the polyester resin A to the polyester resin C or the polycarbonate resin D (polyester resin A/(polyester resin C or polycarbonate resin D)).

TABLE 6

| | Charge-transporting substance | Polyester resin F | Content (% by mass) of formula (A), formula (F-3) and formula (F-4) | Polyester resin C or Polycarbonate resin D | Mixing ratio |
|---|---|---|---|---|---|
| Comparative Example 1 | (E-1)/(E-2) = 9/1 | — | — | (C-1)/(C-2) = 5/5 | — |
| Comparative Example 2 | (E-1)/(E-2) = 9/1 | — | — | C-3 | — |
| Comparative Example 3 | (E-1)/(E-2) = 9/1 | — | — | D-1 | — |
| Comparative Example 4 | E-3 | — | — | D-2 | — |
| Comparative Example 5 | E-4 | — | — | D-3 | — |
| Comparative Example 6 | (E-1)/(E-2) = 9/1 | Resin F(1) | 4 | (C-1)/(C-2) = 5/5 | 3/7 |
| Comparative Example 7 | (E-1)/(E-2) = 9/1 | Resin F(1) | 4 | D-1 | 3/7 |
| Comparative Example 8 | E-3 | Resin F(1) | 4 | D-2 | 3/7 |
| Comparative Example 9 | (E-1)/(E-2) = 9/1 | Resin F(2) | 50 | (C-1)/(C-2) = 5/5 | 3/7 |

TABLE 6-continued

| | Charge-transporting substance | Polyester resin F | Content (% by mass) of formula (A), formula (F-3) and formula (F-4) | Polyester resin C or Polycarbonate resin D | Mixing ratio |
|---|---|---|---|---|---|
| Comparative Example 10 | (E-1)/(E-2) = 9/1 | Resin F(2) | 50 | D-1 | 3/7 |
| Comparative Example 11 | E-3 | Resin F(2) | 50 | D-2 | 3/7 |
| Comparative Example 12 | (E-1)/(E-2) = 9/1 | Resin F(3) | 20 | (C-1)/(C-2) = 5/5 | 3/7 |
| Comparative Example 13 | (E-1)/(E-2) = 9/1 | Resin F(3) | 20 | D-1 | 3/7 |
| Comparative Example 14 | E-3 | Resin F(3) | 20 | D-2 | 3/7 |
| Comparative Example 15 | (E-1)/(E-2) = 9/1 | Resin F(4) | 30 | (C-1)/(C-2) = 5/5 | 3/7 |
| Comparative Example 16 | (E-1)/(E-2) = 9/1 | Resin F(4) | 30 | D-1 | 3/7 |
| Comparative Example 17 | E-3 | Resin F(4) | 30 | D-2 | 3/7 |
| Comparative Example 18 | (E-1)/(E-2) = 9/1 | Resin F(5) | 20 | (C-1)/(C-2) = 5/5 | 3/7 |
| Comparative Example 19 | (E-1)/(E-2) = 9/1 | Resin F(5) | 20 | D-1 | 3/7 |
| Comparative Example 20 | E-3 | Resin F(5) | 20 | D-2 | 3/7 |
| Comparative Example 21 | (E-1)/(E-2) = 9/1 | Resin F(6) | 20 | (C-1)/(C-2) = 5/5 | 3/7 |
| Comparative Example 22 | (E-1)/(E-2) = 9/1 | Resin F(6) | 20 | D-1 | 3/7 |
| Comparative Example 23 | E-3 | Resin F(6) | 20 | D-2 | 3/7 |
| Comparative Example 24 | (E-1)/(E-2) = 9/1 | Resin F(7) | 20 | — | 10/0 |

In Table 6, "Charge-transporting substance" represents the charge-transporting substance contained in the charge-transporting layer of Comparative Examples, indicating the kind of charge-transporting substances and a mixing ratio in the case of mixed use of charge-transporting substances. In Table 6, "Content (% by mass) of formula (A), formula (F-3) and formula (F-4)" represents the content (% by mass) of the structural units represented by Formula (A), Formula (F-3) and Formula (F-4) in the polyester resin F. In Table 6, "Polyester resin C or polycarbonate resin D" represents a structural unit represented by Formulas (C-1) to (C-12), or (D-1) to (D-8) of the polyester resin C or the polycarbonate resin D for use in Comparative Examples. In Table 6, "Mixing ratio" represents the mixing ratio of the polyester resin F to the polyester resin C or the polycarbonate resin D (polyester resin F/(polyester resin C or polycarbonate resin D)).

TABLE 7

| | Potential variation (V) | Photo memory (V) | Relative value of initial torque | Relative value of torque after use for 3,000 sheets | Number average particle size (nm) |
|---|---|---|---|---|---|
| Example 1 | 25 | 5 | 0.61 | 0.65 | 200 |
| Example 2 | 27 | 10 | 0.55 | 0.62 | 400 |
| Example 3 | 8 | 9 | 0.63 | 0.60 | 270 |
| Example 4 | 13 | 14 | 0.53 | 0.60 | 480 |
| Example 5 | 10 | 10 | 0.65 | 0.68 | 320 |
| Example 6 | 15 | 11 | 0.58 | 0.62 | 550 |
| Example 7 | 12 | 8 | 0.60 | 0.63 | 450 |
| Example 8 | 10 | 7 | 0.62 | 0.64 | 390 |
| Example 9 | 9 | 5 | 0.63 | 0.68 | 290 |
| Example 10 | 8 | 12 | 0.63 | 0.65 | 400 |
| Example 11 | 12 | 10 | 0.60 | 0.59 | 420 |

TABLE 7-continued

| | Potential variation (V) | Photo memory (V) | Relative value of initial torque | Relative value of torque after use for 3,000 sheets | Number average particle size (nm) |
|---|---|---|---|---|---|
| Example 12 | 10 | 9 | 0.61 | 0.62 | 440 |
| Example 13 | 15 | 12 | 0.52 | 0.60 | 600 |
| Example 14 | 17 | 15 | 0.51 | 0.61 | 720 |
| Example 15 | 16 | 17 | 0.53 | 0.59 | 730 |
| Example 16 | 15 | 16 | 0.55 | 0.57 | 740 |
| Example 17 | 11 | 18 | 0.57 | 0.59 | 690 |
| Example 18 | 15 | 14 | 0.59 | 0.62 | 800 |
| Example 19 | 5 | 8 | 0.60 | 0.63 | 400 |
| Example 20 | 7 | 10 | 0.62 | 0.62 | 350 |
| Example 21 | 7 | 9 | 0.63 | 0.60 | 410 |
| Example 22 | 6 | 8 | 0.62 | 0.60 | 390 |
| Example 23 | 9 | 11 | 0.58 | 0.59 | 440 |
| Example 24 | 10 | 10 | 0.55 | 0.57 | 500 |
| Example 25 | 12 | 10 | 0.56 | 0.53 | 520 |
| Example 26 | 11 | 13 | 0.57 | 0.55 | 510 |
| Example 27 | 15 | 18 | 0.52 | 0.59 | 700 |
| Example 28 | 10 | 7 | 0.60 | 0.64 | 260 |
| Example 29 | 16 | 17 | 0.53 | 0.57 | 710 |
| Example 30 | 13 | 15 | 0.56 | 0.55 | 750 |
| Example 31 | 17 | 19 | 0.53 | 0.52 | 820 |
| Example 32 | 19 | 18 | 0.54 | 0.53 | 840 |
| Example 33 | 21 | 19 | 0.53 | 0.54 | 790 |
| Example 34 | 8 | 10 | 0.60 | 0.62 | 290 |
| Example 35 | 7 | 8 | 0.63 | 0.64 | 320 |
| Example 36 | 9 | 11 | 0.60 | 0.61 | 400 |
| Example 37 | 12 | 10 | 0.59 | 0.64 | 420 |
| Example 38 | 15 | 16 | 0.55 | 0.58 | 700 |
| Example 39 | 17 | 15 | 0.53 | 0.59 | 770 |
| Example 40 | 22 | 19 | 0.55 | 0.59 | 820 |
| Example 41 | 21 | 23 | 0.57 | 0.60 | 790 |
| Example 42 | 5 | 4 | 0.69 | 0.70 | 250 |
| Example 43 | 12 | 10 | 0.62 | 0.60 | 350 |

TABLE 7-continued

| | Potential variation (V) | Photo memory (V) | Relative value of initial torque | Relative value of torque after use for 3,000 sheets | Number average particle size (nm) |
|---|---|---|---|---|---|
| Example 44 | 20 | 17 | 0.55 | 0.56 | 760 |
| Example 45 | 8 | 12 | 0.63 | 0.62 | 450 |
| Example 46 | 12 | 15 | 0.60 | 0.59 | 600 |
| Example 47 | 9 | 7 | 0.64 | 0.66 | 480 |
| Example 48 | 13 | 15 | 0.59 | 0.62 | 600 |
| Example 49 | 8 | 8 | 0.64 | 0.62 | 500 |
| Example 50 | 12 | 10 | 0.54 | 0.57 | 620 |
| Example 51 | 6 | 7 | 0.67 | 0.68 | 320 |
| Example 52 | 8 | 6 | 0.68 | 0.67 | 350 |
| Example 53 | 10 | 11 | 0.60 | 0.63 | 270 |

TABLE 8

| | Potential variation (V) | Photo memory (V) | Relative value of initial torque | Relative value of torque after use for 3,000 sheets | Number average particle size (nm) |
|---|---|---|---|---|---|
| Example 54 | 27 | 6 | 0.65 | 0.67 | 300 |
| Example 55 | 9 | 11 | 0.63 | 0.64 | 340 |
| Example 56 | 7 | 8 | 0.67 | 0.63 | 290 |
| Example 57 | 13 | 17 | 0.57 | 0.59 | 450 |
| Example 58 | 8 | 5 | 0.64 | 0.65 | 480 |
| Example 59 | 10 | 9 | 0.64 | 0.63 | 460 |
| Example 60 | 10 | 6 | 0.65 | 0.61 | 500 |
| Example 61 | 12 | 14 | 0.60 | 0.59 | 610 |
| Example 62 | 15 | 16 | 0.56 | 0.54 | 680 |
| Example 63 | 18 | 19 | 0.52 | 0.53 | 720 |
| Example 64 | 7 | 6 | 0.65 | 0.64 | 420 |
| Example 65 | 6 | 9 | 0.64 | 0.66 | 390 |
| Example 66 | 10 | 12 | 0.59 | 0.56 | 480 |
| Example 67 | 12 | 11 | 0.57 | 0.58 | 460 |
| Example 68 | 15 | 17 | 0.55 | 0.54 | 620 |
| Example 69 | 20 | 18 | 0.52 | 0.55 | 780 |
| Example 70 | 7 | 10 | 0.63 | 0.67 | 290 |
| Example 71 | 6 | 8 | 0.66 | 0.69 | 270 |
| Example 72 | 10 | 11 | 0.59 | 0.62 | 400 |
| Example 73 | 12 | 10 | 0.58 | 0.59 | 510 |
| Example 74 | 16 | 15 | 0.54 | 0.55 | 610 |
| Example 75 | 21 | 23 | 0.54 | 0.52 | 790 |
| Example 76 | 9 | 7 | 0.63 | 0.64 | 490 |
| Example 77 | 7 | 8 | 0.64 | 0.66 | 360 |
| Example 78 | 10 | 11 | 0.64 | 0.63 | 340 |
| Example 79 | 7 | 5 | 0.68 | 0.67 | 250 |

TABLE 9

| | Potential variation (V) | Photo memory (V) | Relative value of initial torque | Relative value of torque after use for 3,000 sheets | Number average particle size (nm) |
|---|---|---|---|---|---|
| Example 80 | 8 | 8 | 0.64 | 0.65 | 320 |
| Example 81 | 7 | 6 | 0.68 | 0.65 | 290 |
| Example 82 | 10 | 8 | 0.66 | 0.67 | 300 |
| Example 83 | 7 | 9 | 0.64 | 0.68 | 350 |
| Example 84 | 6 | 7 | 0.66 | 0.61 | 360 |
| Example 85 | 8 | 6 | 0.64 | 0.67 | 290 |
| Example 86 | 12 | 10 | 0.59 | 0.60 | 450 |
| Example 87 | 7 | 5 | 0.68 | 0.70 | 260 |
| Example 88 | 10 | 8 | 0.66 | 0.65 | 310 |
| Example 89 | 8 | 9 | 0.64 | 0.67 | 300 |
| Example 90 | 16 | 15 | 0.57 | 0.58 | 520 |
| Example 91 | 8 | 6 | 0.67 | 0.64 | 320 |
| Example 92 | 7 | 9 | 0.64 | 0.61 | 360 |
| Example 93 | 6 | 6 | 0.67 | 0.68 | 280 |
| Example 94 | 7 | 10 | 0.64 | 0.65 | 360 |

TABLE 9-continued

| | Potential variation (V) | Photo memory (V) | Relative value of initial torque | Relative value of torque after use for 3,000 sheets | Number average particle size (nm) |
|---|---|---|---|---|---|
| Example 95 | 7 | 6 | 0.63 | 0.64 | 310 |
| Example 96 | 6 | 10 | 0.65 | 0.67 | 290 |
| Example 97 | 9 | 12 | 0.62 | 0.63 | 390 |
| Example 98 | 9 | 8 | 0.67 | 0.64 | 350 |
| Example 99 | 7 | 8 | 0.67 | 0.67 | 280 |
| Example 100 | 16 | 14 | 0.59 | 0.58 | 510 |

TABLE 10

| | Potential variation (V) | Photo memory (V) | Relative value of initial torque | Relative value of torque after use for 3,000 sheets | Number average particle size (nm) |
|---|---|---|---|---|---|
| Example 101 | 18 | 9 | 0.66 | 0.61 | 350 |
| Example 102 | 17 | 10 | 0.59 | 0.65 | 480 |
| Example 103 | 20 | 7 | 0.64 | 0.60 | 330 |
| Example 104 | 21 | 7 | 0.60 | 0.68 | 520 |
| Example 105 | 16 | 10 | 0.66 | 0.61 | 360 |
| Example 106 | 20 | 6 | 0.58 | 0.70 | 480 |
| Example 107 | 18 | 8 | 0.65 | 0.65 | 310 |
| Example 108 | 17 | 9 | 0.59 | 0.70 | 490 |

TABLE 11

| | Potential variation (V) | Photo memory (V) | Relative value of initial torque | Relative value of torque after use for 3,000 sheets | Number average particle size (nm) |
|---|---|---|---|---|---|
| Comparative Example 1 | 10 | 8 | 1.00 | 1.00 | — |
| Comparative Example 2 | 13 | 8 | 1.00 | 1.00 | — |
| Comparative Example 3 | 7 | 9 | 1.00 | 1.00 | — |
| Comparative Example 4 | 6 | 11 | 1.00 | 1.00 | — |
| Comparative Example 5 | 8 | 8 | 1.00 | 1.00 | — |
| Comparative Example 6 | 26 | 23 | 0.97 | 0.95 | — |
| Comparative Example 7 | 25 | 20 | 0.97 | 1.00 | — |
| Comparative Example 8 | 22 | 24 | 0.98 | 0.96 | — |
| Comparative Example 9 | 120 | 120 | 0.63 | 0.69 | 900 |
| Comparative Example 10 | 130 | 110 | 0.67 | 0.64 | 1030 |
| Comparative Example 11 | 110 | 90 | 0.61 | 0.64 | 970 |
| Comparative Example 12 | 55 | 26 | 0.75 | 0.92 | — |
| Comparative Example 13 | 62 | 25 | 0.69 | 0.93 | — |
| Comparative Example 14 | 58 | 30 | 0.71 | 0.90 | — |
| Comparative Example 15 | 203 | 100 | 0.60 | 0.64 | 1130 |
| Comparative Example 16 | 230 | 97 | 0.57 | 0.62 | 1200 |
| Comparative Example 17 | 227 | 107 | 0.56 | 0.66 | 1080 |
| Comparative Example 18 | 25 | 38 | 0.69 | 0.74 | 340 |

TABLE 11-continued

| | Potential variation (V) | Photo memory (V) | Relative value of initial torque | Relative value of torque after use for 3,000 sheets | Number average particle size (nm) |
|---|---|---|---|---|---|
| Comparative Example 19 | 22 | 37 | 0.73 | 0.75 | 360 |
| Comparative Example 20 | 26 | 35 | 0.75 | 0.80 | 320 |
| Comparative Example 21 | 20 | 31 | 0.67 | 0.70 | 330 |
| Comparative Example 22 | 21 | 33 | 0.65 | 0.67 | 350 |
| Comparative Example 23 | 18 | 30 | 0.65 | 0.69 | 360 |
| Comparative Example 24 | 154 | 135 | 0.64 | 0.67 | — |

TABLE 12

| Polyester resin F | Formula (A) or formula (F) Structural unit | Average value of n | Formula (B) | Formula (C) | Content of formula (A) and formula (F) | Content of formula (B) | Weight average molecular weight |
|---|---|---|---|---|---|---|---|
| Resin F(1) | (A-10) | 40 | (B-3) | — | 4 | 96 | 90,000 |
| Resin F(2) | (A-10) | 40 | (B-3) | — | 50 | 50 | 110,000 |
| Resin F(3) | (F-3) | 10 | (B-3) | — | 20 | 80 | 130,000 |
| Resin F(4) | (F-4) | 170 | (B-3) | — | 30 | 70 | 100,000 |
| Resin F(5) | (A-10) | 40 | — | (C-3) | 20 | — | 110,000 |
| Resin F(6) | (A-10) | 40 | (B-3) | (C-3) | 20 | 40 | 100,000 |
| Resin F(7) | (A-2)/(A-6) = 5/5 | 40(40/40) | (B-1)/(B-2) = 5/5 | — | 20 | 80 | 110,000 |

In Table 12, "Formula (A) or formula (F)" represents the structural unit represented by Formula (A) or Formula (F). "Average value of n" represents the average value of n of the total structural units represented by Formula (A) or Formula (F) included in the polyester resin F. The average value of n for each structural unit is described in parentheses in the case of mixed use of the structural units represented by Formula (A) or Formula (F). "Formula (B)" represents the structural unit represented by Formula (B). "Formula (C)" represents the structural unit represented by Formula (C). "Content of formula (A) and formula (F)" represents the content (% by mass) of the structural unit represented by Formula (A) and Formula (F) in the polyester resin F. "Content of formula (B)" represents the content (% by mass) of the structural unit represented by Formula (B) in the polyester resin F.

TABLE 13

| | Charge-transporting substance | Polyester resin A | Polyester resin C | Mixing ratio |
|---|---|---|---|---|
| Example 109 | (E-1)/(E-2) = 9/1 | Resin A(33) | (C-1)/(C-2) = 5/5 | 3/7 |
| Example 110 | (E-1)/(E-2) = 9/1 | Resin A(34) | (C-1)/(C-2) = 5/5 | 3/7 |
| Example 111 | (E-1)/(E-2) = 9/1 | Resin A(35) | (C-1)/(C-2) = 5/5 | 3/7 |
| Example 112 | (E-1)/(E-2) = 9/1 | Resin A(36) | (C-1)/(C-2) = 5/5 | 3/7 |
| Example 113 | (E-1)/(E-2) = 9/1 | Resin A(37) | (C-1)/(C-2) = 5/5 | 3/7 |
| Example 114 | (E-1)/(E-2) = 9/1 | Resin A(38) | (C-1)/(C-2) = 5/5 | 3/7 |
| Example 115 | (E-1)/(E-2) = 9/1 | Resin A(3)/Resin A(4) = 3/1 | (C-1)/(C-2) = 5/5 | 3/7 |
| Example 116 | (E-1)/(E-2) = 9/1 | Resin A(11)/Resin A(13) = 3/1 | (C-1)/(C-2) = 5/5 | 3/7 |
| Example 117 | (E-1)/(E-5) = 9/1 | Resin A(11) | (C-1)/(C-3) = 3/7 | 3/7 |
| Example 118 | (E-1)/(E-5) = 9/1 | Resin A(33) | (C-1)/(C-3) = 3/7 | 3/7 |
| Example 119 | (E-1)/(E-5) = 9/1 | Resin A(35) | (C-1)/(C-3) = 3/7 | 3/7 |
| Example 120 | (E-1)/(E-5) = 9/1 | Resin A(37) | (C-1)/(C-3) = 3/7 | 3/7 |

In Table 13, "Charge-transporting substance" represents the charge-transporting substance contained in the charge-transporting layer in Examples, indicating the kind of charge-transporting substances and a mixing ratio in the case of mixed use of charge-transporting substances. In Table 13, "Polyester resin C" represents a structural unit represented by Formulas (C-1) to (C-12) of the polyester resin C for use in Examples. In Table 13, "Mixing ratio" represents the mixing ratio of the polyester resin A to the polyester resin C (polyester resin A/(polyester resin C)).

TABLE 14

| | Potential variation (V) | Photo memory (V) | Relative value of initial torque | Relative value of torque after use for 3,000 sheets | Number average particle size (nm) |
|---|---|---|---|---|---|
| Example 109 | 7 | 10 | 0.72 | 0.62 | 260 |
| Example 110 | 6 | 8 | 0.70 | 0.60 | 260 |
| Example 111 | 7 | 10 | 0.72 | 0.61 | 280 |
| Example 112 | 6 | 8 | 0.71 | 0.62 | 270 |
| Example 113 | 10 | 11 | 0.65 | 0.61 | 310 |
| Example 114 | 9 | 10 | 0.67 | 0.59 | 300 |
| Example 115 | 13 | 11 | 0.60 | 0.65 | 350 |
| Example 116 | 15 | 9 | 0.61 | 0.67 | 330 |
| Example 117 | 8 | 10 | 0.58 | 0.62 | 320 |
| Example 118 | 5 | 9 | 0.60 | 0.57 | 280 |
| Example 119 | 10 | 10 | 0.62 | 0.58 | 290 |
| Example 120 | 12 | 13 | 0.59 | 0.60 | 330 |

In comparison between Examples and Comparative Examples 1 to 5, Comparative Examples obtained insufficient contact stress relaxation effect, because the charge-transporting layer includes no polyester resin A. As a result, the insufficient effect of reduction in initial torque and torque after repeating use for 3,000 sheets was produced in the evaluation by the present evaluation method.

In comparison between Examples and Comparative Examples 6 to 8, Comparative Examples obtained insufficient contact stress relaxation effect. As a result, the insufficient effect of reduction in relative value of initial torque and torque after repeating use for 3,000 sheets was produced in the evaluation by the present evaluation method. As a result, even a polyester resin which contains a structural unit represented by Formula (A) and a structural unit represented by Formula (B) obtained insufficient contact stress relaxation effect, in the case of too little content of the structural unit represented by Formula (A) in the polyester resin.

In comparison between Examples and Comparative Examples 9 to 11, although Comparative Examples obtained sustained contact stress relaxation effect, large potential variation and photo memory resulted. The results are believed due to a barrier to the charge mobility from a charge-generating layer to a charge-transporting layer, caused by the localization of the polyester resin A at the interface between a charge-transporting layer and a charge-generating layer due to too much content of the structural unit represented by Formula (A) in the polyester resin A. As a result, the insufficient reduction effect in the potential variation and photo memory was produced.

In comparison between Examples and Comparative Examples 12 to 14, Comparative Examples obtained insufficient sustained contact stress relaxation effect. As a result, the insufficient reduction effect of relative value of torque after repeating use for 3,000 sheets was produced in the evaluation by the present evaluation method. In addition, Comparative Examples had a large potential variation. The results showed that too small average value n of the number of repetitions of the structural unit represented by Formula (A) in a polyester resin A allows no matrix-domain structure to form, producing insufficient sustained contact stress relaxation effect and potential variation reduction effect.

In comparison between Examples and Comparative Examples 15 to 17, although Comparative Examples obtained sustained contact stress relaxation effect, large potential variation and photo memory resulted. The results were due to the localization of the polyester resin A at the interface between a charge-transporting layer and a charge generating layer, easily caused by too large average value of n of the number of repetitions of the structural unit represented by Formula (A) in the polyester resin A. It is believed that the localization formed a barrier to the charge mobility from a charge-generating layer to a charge-transporting layer, producing insufficient effect of reduction in potential variation and photo memory.

In comparison between Examples and Comparative Examples 18 to 23, Comparative Examples obtained insufficient effect of reduction in photo memory. It is believed that the polyester resin A which includes no structural unit represented by Formula (B) or the polyester resin A which includes too little content of the structural unit represented by Formula (B) caused the results. It is believed that the polyester resin A of this type reduced the effect for preventing a charge from staying in the portion of an electrophotographic photosensitive member irradiated with light, so that insufficient effect of reduction in photo memory was produced.

In comparison between Examples and Comparative Example 24, in the case of a charge-transporting layer formed of the polyester resin A only, the results showed that although the sustained contact stress relaxation effect was obtained, the effect of reduction in potential variation and photo memory was insufficient.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-215700, filed Sep. 28, 2012, No. 2013-037485, filed Feb. 27, 2013, and No. 2013-186345, filed Sep. 9, 2013, which are hereby incorporated by reference herein in their entirety.

What is claimed is:

1. An electrophotographic photosensitive member comprising:

a support;

a charge-generating layer formed on the support; and a charge-transporting layer formed on the charge-generating layer;

wherein, the charge-transporting layer is a surface layer of the electrophotographic photosensitive member, the charge-transporting layer has a matrix-domain structure having:

a domain which comprises a polyester resin A having:

a structural unit represented by the following Formula (A) and a structural unit represented by the following Formula (B), and a matrix which comprises:

a charge-transporting substance, and at least one resin selected from the group consisting of a polyester resin C having a structural unit represented by the following Formula (C) and a polycarbonate resin D having a structural unit represented by the following Formula (D), the content of the structural unit represented by the Formula (A) is 6% by mass or more and 40% by mass or less based on the total mass of the polyester resin A, and the content of the structural unit represented by the Formula (B) is 60% by mass or more and 94% by mass or less based on the total mass of the polyester resin A:

(A)

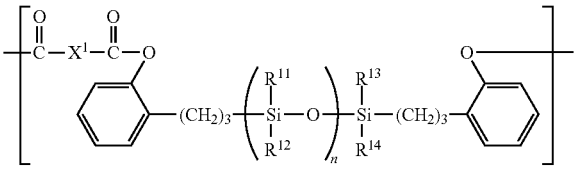

wherein, $X^1$ represents a m-phenylene group, a p-phenylene group, or a bivalent group having two p-phenylene groups bonded to an oxygen atom, $R^{11}$ to $R^{14}$ each independently represent, a methyl group, an ethyl group or a phenyl group, n represents the number of repetitions of a structure in brackets, and an average value of n in the polyester resin A is 20 or more and 120 or less;

(B)

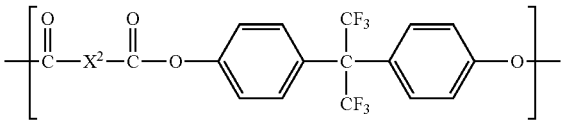

wherein, $X^2$ represents a m-phenylene group, a p-phenylene group, or a bivalent group having two p-phenylene groups bonded to an oxygen atom;

(C)

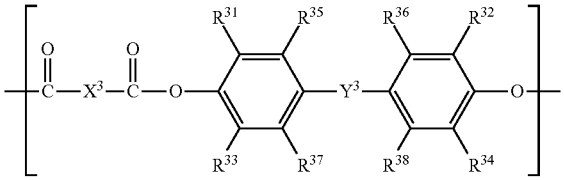

wherein, $R^{31}$ to $R^{38}$ each independently represent a hydrogen atom, or a methyl group, $X^3$ represents a m-phenylene group, a p-phenylene group, or a bivalent group having two p-phenylene groups bonded to an oxygen atom, and $Y^3$ represents a single bond, a methylene group, an ethylidene group, or a propylidene group;

(D)

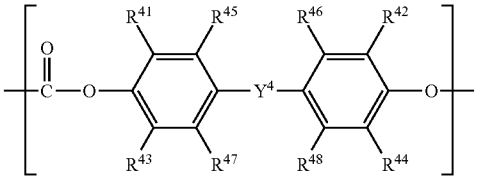

wherein, $R^{41}$ to $R^{48}$ each independently represent a hydrogen atom, or a methyl group, and $Y^4$ represents a methylene group, an ethylidene group, a propylidene group, a phenylethylidene group, a cyclohexylidene group, or an oxygen atom, wherein, the structural unit represented by the Formula (B) comprises a structural unit represented by the following Formula (B-3), and the content of the structural unit represented by the Formula (B-3) is 30% by mass or more and 100% by mass or less based on the total mass of the structural unit represented by the Formula (B) in the polyester resin A (B-3)

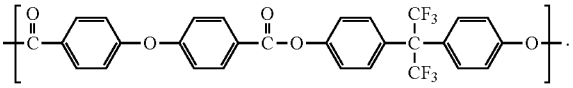

2. The electrophotographic photosensitive member according to claim 1, wherein the content of the structural unit represented by the Formula (A) is 10% by mass or more and 40% by mass or less based on the total mass of the polyester resin A, and the content of the structural unit represented by the Formula (B) is 60% by mass or more and 90% by mass or less based on the total mass of the polyester resin A.

3. The electrophotographic photosensitive member according to claim 1, wherein the content of the structural unit represented by the Formula (A) is 6% by mass or more and less than 10% by mass based on the total mass of the polyester resin A, and the content of the structural unit represented by the Formula (B) is more than 90% by mass and 94% by mass or less based on the total mass of the polyester resin A.

4. The electrophotographic photosensitive member according to claim 1, wherein the content of the polyester resin A in the charge-transporting layer is 10% by mass or more and 40% by mass or less based on the total mass of all the resins in the charge-transporting layer.

5. The electrophotographic photosensitive member according to claim 1, wherein the charge-transporting substance comprises at least one selected from the group consisting of a triarylamine compound, a hydrazone compound, a butadiene compound and an enamine compound.

6. The electrophotographic photosensitive member according to claim 5, wherein the charge-transporting substance is a compound represented by one of the following formulas (E-4) and (E-5)

(E-4)

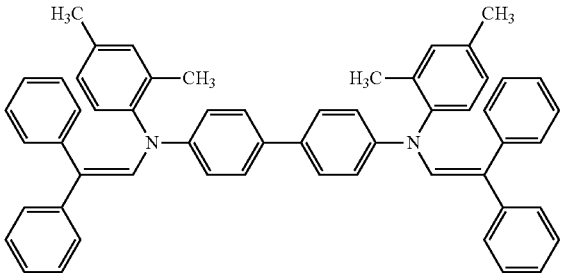

(E-5)

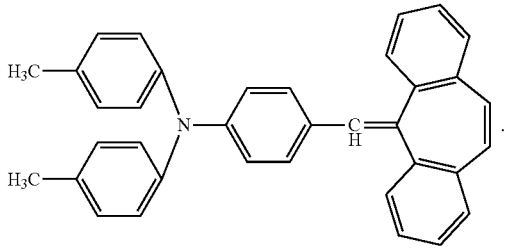

7. A process cartridge detachably attachable to a main body of an electrophotographic apparatus, wherein the process cartridge integrally supports:

the electrophotographic photosensitive member according to claim 1 and at least one unit selected from the group consisting of a charging unit, a developing unit, a transferring unit and a cleaning unit.

8. An electrophotographic apparatus comprising the electrophotographic photosensitive member according to claim 1, a charging unit, an exposure unit, a developing unit, and a transferring unit.

9. A method for manufacturing an electrophotographic photosensitive member comprising a support, a charge-generating layer formed on the support, and a charge-transporting layer formed on the charge-generating layer as a surface layer of the electrophotographic photosensitive member, wherein the method comprises:

forming a coating film of a charge-transporting layer coating liquid on the charge-generating layer, the charge-transporting layer coating liquid comprising:

a polyester resin A having a structural unit represented by the following Formula (A) and a structural unit represented by the following Formula (B), at least one resin selected from the group consisting of a polyester resin C having a structural unit represented by the following Formula (C) and a polycarbonate resin D having a structural unit represented by the following Formula (D), and a charge-transporting substance;

and forming the charge-transporting layer by drying the coating film;

the content of the structural unit represented by the Formula (A) is 6% by mass or more and 40% by mass or less based on the total mass of the polyester resin A, and the content of the structural unit represented by the Formula (B) is 60% by mass or more and 94% by mass or less based on the total mass of the polyester resin A:

(A)

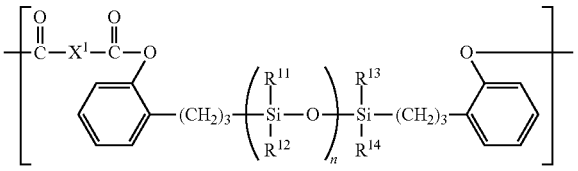

wherein, $X^1$ represents a m-phenylene group, a p-phenylene group, or a bivalent group having two p-phenylene groups bonded to an oxygen atom, $R^{11}$ to $R^{14}$ each independently represent, a methyl group, an ethyl group or a phenyl group, n represents the number of repetitions of a structure in brackets, and an average value of n in the polyester resin A is 20 or more and 120 or less;

(B)

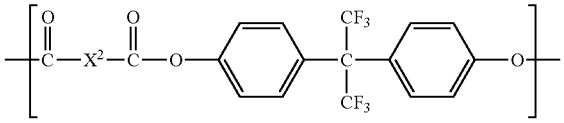

wherein, $X^2$ represents a m-phenylene group, a p-phenylene group, or a bivalent group having two p-phenylene groups bonded to an oxygen atom;

(C)

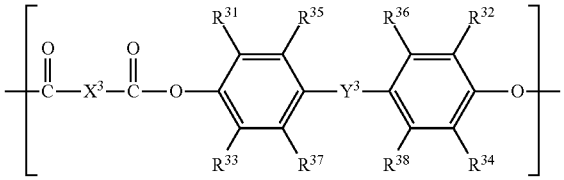

wherein, $R^{31}$ to $R^{38}$ each independently represent a hydrogen atom, or a methyl group, $X^3$ represents a m-phenylene group, a p-phenylene group, or a bivalent group having two p-phenylene groups bonded to an oxygen atom, and $Y^3$ represents a single bond, a methylene group, an ethylidene group, or a propylidene group;

(D)

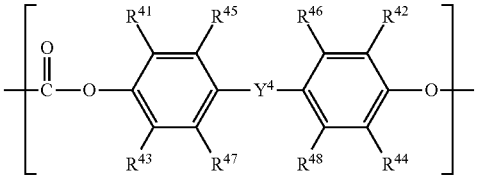

wherein, $R^{41}$ to $R^{48}$ each independently represent a hydrogen atom, or a methyl group, and $Y^4$ represents a methylene group, an ethylidene group, a propylidene group, a phenylethylidene group, a cyclohexylidene group, or an oxygen atom wherein, the structural unit represented by the Formula (B) comprises a structural unit represented by the following Formula (B-3), and the content of the structural unit represented by the Formula (B-3) is 30% by mass or more and 100% by mass or less based on the total mass of the structural unit represented by the Formula (B) in the polyester resin A (B-3)

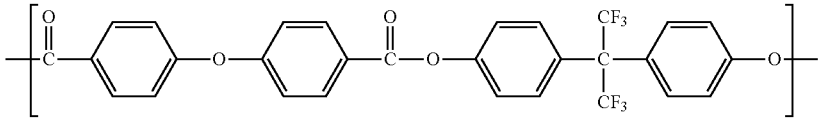

and wherein the charge-transporting layer has a matrix-domain structure having a domain which comprises the polyester resin A, and a matrix which comprises the charge transporting substance and the at least one resin.

* * * * *